US010760518B2

(12) United States Patent
Pursifull et al.

(10) Patent No.: US 10,760,518 B2
(45) Date of Patent: Sep. 1, 2020

(54) METHOD AND SYSTEM FOR CHARACTERIZING A PORT FUEL INJECTOR

(71) Applicant: Ford Global Technologies, LLC, Dearborn, MI (US)

(72) Inventors: Ross Dykstra Pursifull, Dearborn, MI (US); Adithya Pravarun Re Ranga, Canton, MI (US); Gopichandra Surnilla, West Bloomfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 262 days.

(21) Appl. No.: 15/592,078

(22) Filed: May 10, 2017

(65) Prior Publication Data

US 2018/0328304 A1 Nov. 15, 2018

(51) Int. Cl.
*F02D 41/24* (2006.01)
*F02D 41/30* (2006.01)
(Continued)

(52) U.S. Cl.
CPC ..... *F02D 41/2467* (2013.01); *F02D 41/2432* (2013.01); *F02D 41/3094* (2013.01); *F02D 41/3845* (2013.01); *F02D 41/3854* (2013.01); *F02D 13/0207* (2013.01); *F02D 2041/2051* (2013.01); *F02D 2041/2062* (2013.01);
(Continued)

(58) Field of Classification Search
CPC ..... F02D 41/2467; F02D 2200/0606; F02D 2041/2062; F02D 2041/2051; F02D 2041/2065; F02D 2041/3881; F02D 41/3845; F02D 41/3854; F02D 41/2432; F02D 41/3094
See application file for complete search history.

(56) References Cited

U.S. PATENT DOCUMENTS 4,989,150 A 1/1991 Tazawa
9,562,488 B1 * 2/2017 Bowling ..... F02D 41/2467
(Continued)

FOREIGN PATENT DOCUMENTS

EP 2042716 A1 * 4/2009 ..... F02D 41/20
WO WO-2009089937 A2 * 7/2009 ..... F02D 41/3845

OTHER PUBLICATIONS

Pursifull, R. et al., "Method and System for Characterizing a Port Fuel Injector," U.S. Appl. No. 15/592,106, filed May 10, 2017, 78 pages.

*Primary Examiner* — Mahmoud Gimie
*Assistant Examiner* — Joshua Campbell
(74) *Attorney, Agent, or Firm* — Geoffrey Brumbaugh; McCoy Russell LLP

(57) ABSTRACT

Methods and systems are provided for calibrating engine port injectors. After pressurizing a low pressure fuel rail, a lift pump may be disabled and port injector variability may be correlated with a measured fuel rail pressure drop at each port injection event by sweeping injection pressure while maintaining injection voltage, and then sweeping injection voltage while maintaining injection pressure. A port injector variability map learned as a function of injection voltage and injection pressure is then transformed into a map learned as a function of injection current and injection pressure by accounting for injector variability caused due to changes in injector temperature.

15 Claims, 10 Drawing Sheets

(51) Int. Cl.
*F02D 41/38* (2006.01)
*F02D 41/20* (2006.01)
*F02D 13/02* (2006.01)

(52) U.S. Cl.
CPC ..... *F02D 2041/2065* (2013.01); *F02D 2041/3881* (2013.01); *F02D 2200/0602* (2013.01); *F02D 2200/0606* (2013.01); *F02D 2200/0616* (2013.01)

(56) References Cited

U.S. PATENT DOCUMENTS

| | | | | |
|---|---|---|---|---|
| 2002/0162542 | A1 | 11/2002 | Dutart et al. | |
| 2005/0098155 | A1* | 5/2005 | Yamazaki | F02D 41/3094 123/431 |
| 2008/0269980 | A1 | 10/2008 | Spivak | |
| 2009/0306874 | A1* | 12/2009 | Tanaka | F02D 41/0002 701/102 |
| 2011/0144886 | A1* | 6/2011 | Carter | F02D 41/3094 701/103 |
| 2014/0366845 | A1* | 12/2014 | Kramer | F02D 41/3845 123/464 |
| 2015/0240739 | A1 | 8/2015 | Pursifull et al. | |
| 2015/0308314 | A1* | 10/2015 | Axe | F01N 11/00 423/210 |
| 2017/0101955 | A1* | 4/2017 | Bowling | F02D 41/247 |

* cited by examiner

METHOD AND SYSTEM FOR CHARACTERIZING A PORT FUEL INJECTOR

FIELD

The present description relates generally to methods and systems for calibrating a port fuel injector of an engine.

BACKGROUND/SUMMARY

Engines may be configured with direct fuel injectors (DI) for injecting fuel directly into an engine cylinder and/or port fuel injectors (PFI) for injecting fuel into an intake port of an engine cylinder. Fuel injectors often have piece-to-piece and time-to-time variability due to imperfect manufacturing processes and/or injector aging, for example. Over time, injector performance may degrade (e.g., injector becomes clogged) which may further increase piece-to-piece injector variability. As a result, the actual amount of fuel injected to each cylinder of an engine may not be the desired amount and the difference between the actual and desired amounts may vary between injectors. Such discrepancies may lead to reduced fuel economy, increased tailpipe emissions, and an overall decrease in engine efficiency. Further, engines operating with a dual injector system, such as dual fuel or PFDI systems, may have even more fuel injectors (e.g., twice as many) resulting in greater possibility for degradation of engine performance due to injector degradation.

Diverse approaches may be used to estimate the variability in injector performance. One example approach is shown by Pursifull et al. in US20150240739. Therein, a port injector is calibrated by pressurizing both a low pressure and a high pressure fuel rail by operating a low pressure and a high pressure pump, suspending operation of both the pumps simultaneously, and then fueling a single cylinder via port injection while the remaining cylinders are fueled via direct injection. After each port injection event, a pressure decrease in the low pressure fuel rail coupled to the port injector is measured and compared to a predetermined value. Any deviation between the measured pressure drop and the expected pressure drop based on the injected fuel quantity is learned and compensated.

However, the inventors herein recognized potential issues with the above approach. As one example, the approach of Pursifull may not be accurate across all fuel pulse-widths and fuel temperatures. The inventors have herein recognized that port fuel injection accuracy is not only dependent on the injection pressure, but also on injection temperature. The injector temperature not only affects the injector resistance, but also affects the fuel density. Due to the effect of temperature on injector resistance, an injector offset may vary. Injector offset results from the difference in injector opening time and injector closing time. If injector opening delay and closing delay were identical and otherwise symmetric, injector offset would be negligible. However, injector opening is governed by the supply voltage, injector resistance, and injection pressure (for a given injector design and fuel condition). Injector closing is governed by a distinct set parameters. In addition to the injector offset, due to the effect of temperature on the fuel density, the commanded fuel mass and the injected fuel mass may vary, causing further discrepancies between fuel mass commanded on a port injection event and a pressure drop measured at the port injection event. Consequently, as injector temperature changes, as occurs during engine operation due to changing engine loads, the injector performance may vary. Due to the specific position of the port injectors, upstream of a combustion chamber and mounted at the back of a cylinder intake valve, port injector sensitivity to temperature variability may be exacerbated. As another example, the measured pressure drop following a port injection event may be inaccurate at lower fuel rail (or port injection) pressures as well as at lower port injection volumes, such as may occur at low load conditions. Specifically, the fuel quantity injected as a "percent of value" may have reduced accuracy as the fuel quantity or pulse width commanded to the port injector decreases. Likewise, at lower fuel rail pressures, there is a possibility of fuel vapor being ingested instead of liquid fuel, resulting in inaccurate pressure drops being measured. Inaccuracies in the pressure drop measurement may translate to inaccuracies in injector variability estimation. Fuel injector errors can result in air-fuel ratio discrepancies in cylinders, leading to misfires, reduced fuel economy, increased tailpipe emissions, and an overall decrease in engine efficiency.

In one example, the issues described above may be at least partially addressed by a method for an engine comprising: learning port injector variability as a function of injector current, the injector current estimated based on sensed port injection fuel rail temperature; and adjusting port fueling of the engine based on the learning. In this way, the injector offset can be corrected at all temperatures. In this way, the effect of temperature on injector variability may be better accounted for.

As an example, responsive to port fuel injection calibration conditions being met, port injector variability may be mapped as a function of injector voltage. This includes performing a predetermined number of port injection events from each port injector while sweeping injection voltage and while maintaining an injection pressure. At each injection event, a drop in fuel rail pressure may be measured and correlated to an initial parameter indicative of variability for the corresponding injector, thereby generating an initial injector offset map. To improve the accuracy of pressure drop measurement, particularly at low loads, a parallel pressure relief valve may be coupled to an inlet of the fuel rail so as to maintain the fuel rail pressure elevated (e.g., above fuel line pressure) even after the fuel pump is disabled. For each injection event, an injector temperature may be inferred from fuel rail temperature, as sensed via a temperature sensor coupled to the port injection fuel rail. Injector resistance may be calculated based on the inferred injector temperature and the injection voltage. The initial injector offset map which correlates injector variability to injector voltage may then be transformed into an updated injector offset map which relates injector variability to injector current.

In this way, port fuel injector variability may be accurately determined over a wide range of temperature conditions. The technical effect of learning a fuel injection quantity correction as a function of injector voltage, and then mapping it to a function of injector current is that injector variability due to variations in injector or fuel temperature can be accounted for. By using an existing fuel rail temperature sensor to infer injector temperature, the need for dedicated temperature sensors is reduced, providing component and cost reduction benefits. By enabling a port injection fuel rail pressure to be held elevated above a fuel line pressure while a lift pump is disabled, it is possible to provide sufficiently large injection quantities to sustain an accurately measurable fuel rail pressure drop during port injector calibration. By enabling the port injector variability to be learned by running at any fuel pulse-width, the routine is rendered non-intrusive.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
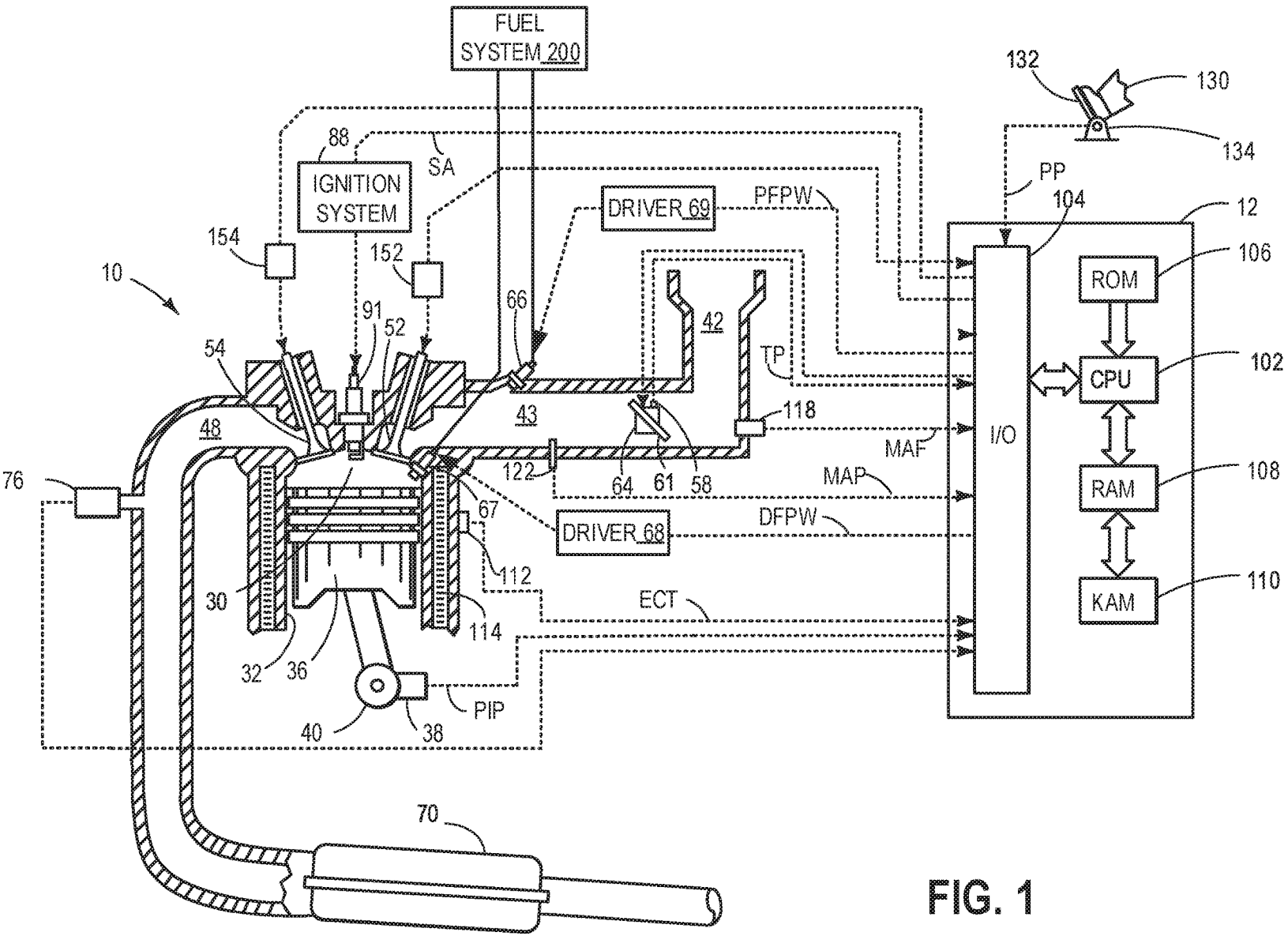
FIG. 1 shows a schematic depiction of an engine system.
Figure 3:
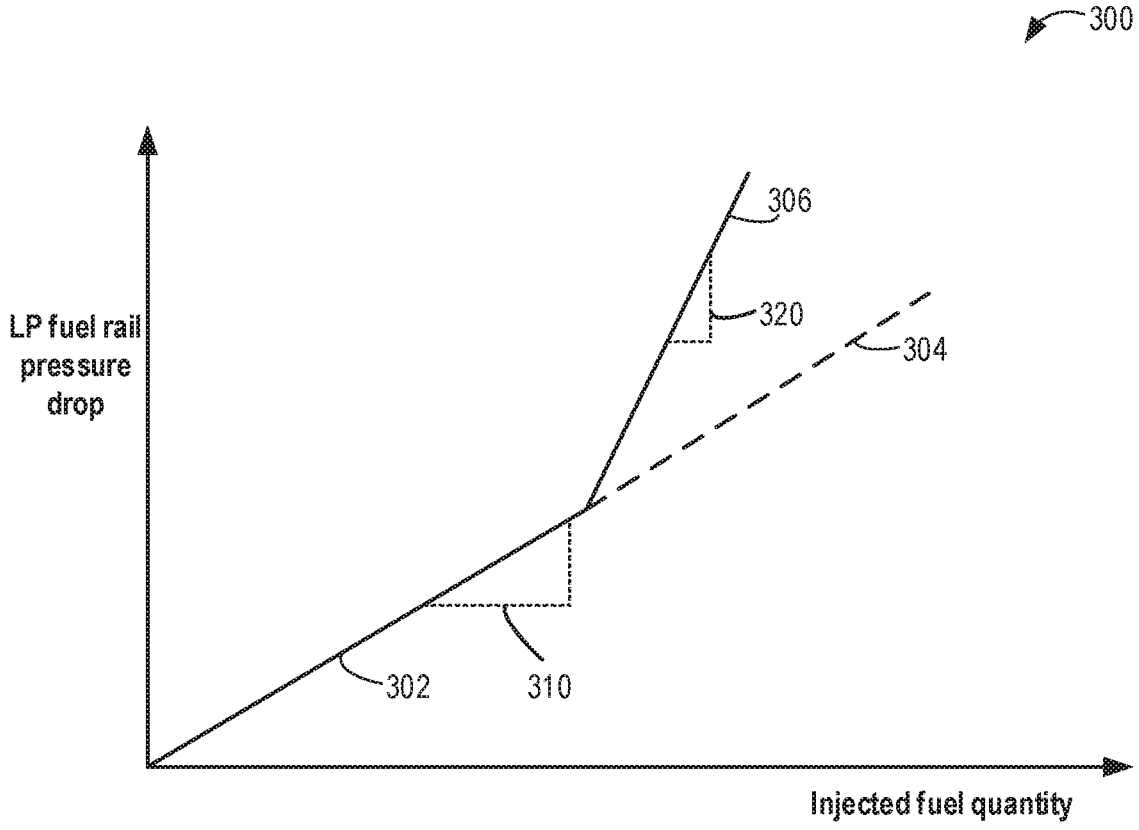
FIG. 3 depicts a graphical relationship between a LP fuel rail pressure drop and injected fuel quantity in a port fuel injection system.
Figure 4:
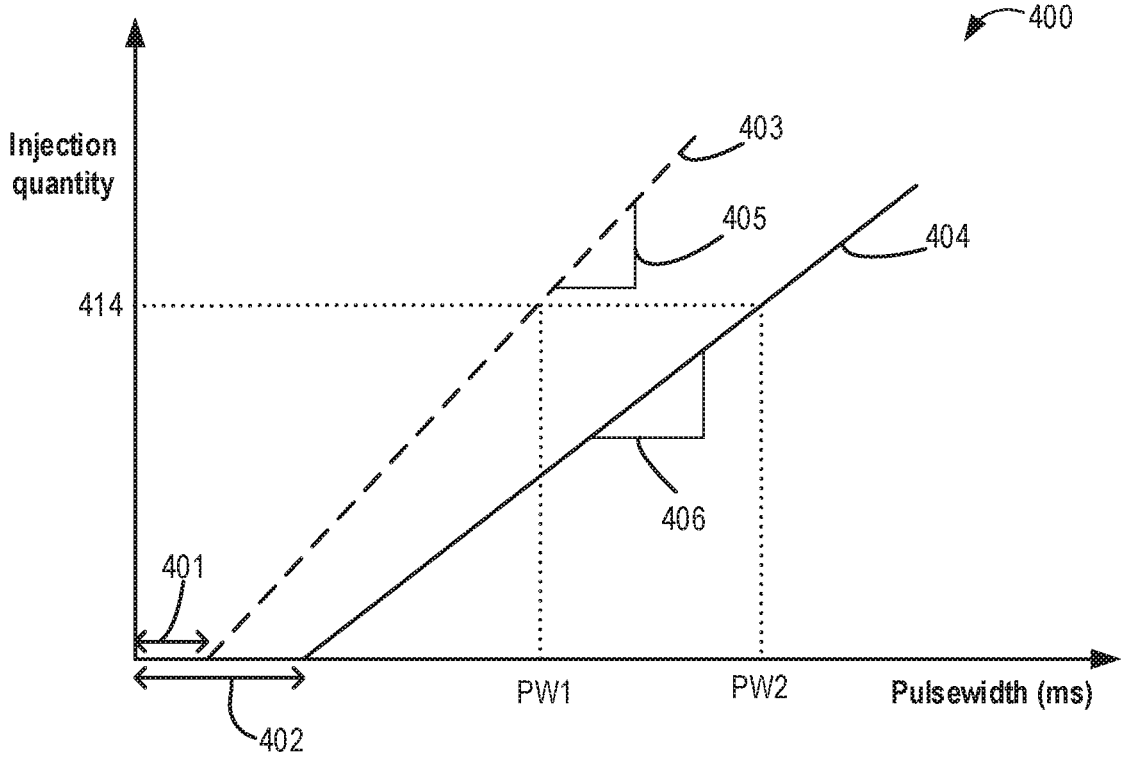
FIG. 4 depicts a graphical relationship between injection quantity and fuel injection pulse-width in a port fuel injection system.

The following description relates to systems and methods for calibrating port fuel injectors in an engine, such as the engine system of FIG. 1. The engine system may be configured with dual fuel injection capabilities, as shown in the fuel system of FIG. 2. The fuel system of FIG. 2 may be equipped with a pressure relief valve for isolating a port injection fuel rail pressure when a lift pump is disabled, as shown at FIG. 3. Port fuel injector variability may be learned as a transfer function correlating injected fuel mass to injector pulse-width, such as illustrated in FIG. 4. A controller may be configured to perform a control routine, such as the example routine of FIGS. 5-7, to learn the variability between port injectors of the engine by correlating a measured drop in fuel rail pressure to each of injection pressure and injection voltage. The controller may be further configured to transform the port injector variability learned as a function of injector voltage to a function of injector current, as shown with reference to FIGS. 8 and 10, to account for variations arising from changes in injector temperature. A prophetic port fuel injector diagnosis is shown with reference to FIG. 9. In this way, port injector-to-injector variability may be reliably measured and fuel injection accuracy can be improved.

FIG. 1 shows a schematic depiction of a spark ignition internal combustion engine 10 with a dual injector system, where engine 10 is configured with both direct and port fuel injection. Engine 10 comprises a plurality of cylinders of which one cylinder 30 (also known as combustion chamber 30) is shown in FIG. 1. Cylinder 30 of engine 10 is shown including combustion chamber walls 32 with piston 36 positioned therein and connected to crankshaft 40. A starter motor (not shown) may be coupled to crankshaft 40 via a flywheel (not shown), or alternatively, direct engine starting may be used.

Combustion chamber 30 is shown communicating with intake manifold 43 and exhaust manifold 48 via intake valve 52 and exhaust valve 54, respectively. In addition, intake manifold 43 is shown with throttle 64 which adjusts a position of throttle plate 61 to control airflow from intake passage 42.

Intake valve 52 may be operated by controller 12 via actuator 152. Similarly, exhaust valve 54 may be activated by controller 12 via actuator 154. During some conditions, controller 12 may vary the signals provided to actuators 152 and 154 to control the opening and closing of the respective intake and exhaust valves. The position of intake valve 52 and exhaust valve 54 may be determined by respective valve position sensors (not shown). The valve actuators may be of the electric valve actuation type or cam actuation type, or a combination thereof. The intake and exhaust valve timing may be controlled concurrently or any of a possibility of variable intake cam timing, variable exhaust cam timing, dual independent variable cam timing or fixed cam timing may be used. Each cam actuation system may include one or more cams and may utilize one or more of cam profile switching (CPS), variable cam timing (VCT), variable valve timing (VVT) and/or variable valve lift (VVL) systems that may be operated by controller 12 to vary valve operation. For example, cylinder 30 may alternatively include an intake valve controlled via electric valve actuation and an exhaust valve controlled via cam actuation including CPS and/or VCT. In other embodiments, the intake and exhaust valves may be controlled by a common valve actuator or actuation system, or a variable valve timing actuator or actuation system.

In another embodiment, four valves per cylinder may be used. In still another example, two intake valves and one exhaust valve per cylinder may be used.

Combustion chamber 30 can have a compression ratio, which is the ratio of volumes when piston 36 is at bottom center to top center. In one example, the compression ratio may be approximately 9:1. However, in some examples where different fuels are used, the compression ratio may be increased. For example, it may be between 10:1 and 11:1 or 11:1 and 12:1, or greater.

In some embodiments, each cylinder of engine 10 may be configured with one or more fuel injectors for providing fuel thereto. As shown in FIG. 1, cylinder 30 includes two fuel injectors, 66 and 67. Fuel injector 67 is shown directly coupled to combustion chamber 30 for delivering injected fuel directly therein in proportion to the pulse width of signal DFPW received from controller 12 via electronic driver 68. In this manner, direct fuel injector 67 provides what is known as direct injection (hereafter referred to as "DI") of fuel into combustion chamber 30. While FIG. 1 shows injector 67 as a side injector, it may also be located overhead of the piston, such as near the position of spark plug 91. Such a position may improve mixing and combustion due to the lower volatility of some alcohol based fuels. Alternatively, the injector may be located overhead and near the intake valve to improve mixing.

Fuel injector 66 is shown arranged in intake manifold 43 in a configuration that provides what is known as port injection of fuel (hereafter referred to as "PFI") into the intake port upstream of cylinder 30 rather than directly into cylinder 30. Port fuel injector 66 delivers injected fuel in proportion to the pulse width of signal PFPW received from controller 12 via electronic driver 69.

Figure 2:
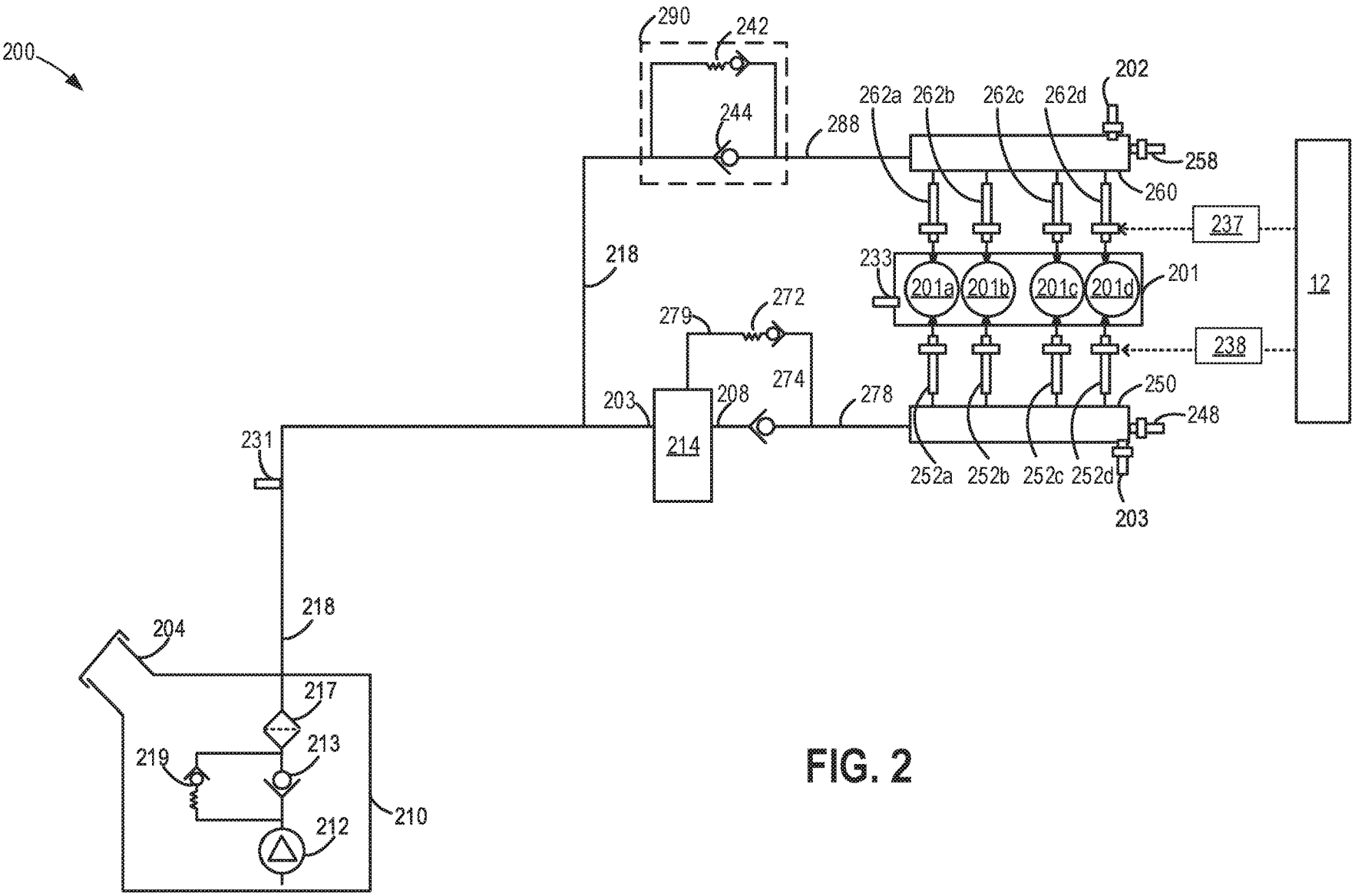
FIG. 2 shows a schematic diagram of a dual injector, single fuel system coupled to the engine system of FIG. 1.

Fuel may be delivered to fuel injectors 66 and 67 by a high pressure fuel system 200 including a fuel tank, fuel pumps, and fuel rails (elaborated at FIG. 2). Further, as shown in FIG. 2, the fuel tank and rails may each have a pressure transducer providing a signal to controller 12.

Exhaust gases flow through exhaust manifold 48 into emission control device 70 which can include multiple catalyst bricks, in one example. In another example, multiple emission control devices, each with multiple bricks, can be used. Emission control device 70 can be a three-way type catalyst in one example.

Exhaust gas sensor 76 is shown coupled to exhaust manifold 48 upstream of emission control device 70 (where sensor 76 can correspond to a variety of different sensors). For example, sensor 76 may be any of many known sensors for providing an indication of exhaust gas air/fuel ratio such as a linear oxygen sensor, a UEGO, a two-state oxygen sensor, an EGO, a HEGO, or an HC or CO sensor. In this particular example, sensor 76 is a two-state oxygen sensor that provides signal EGO to controller 12 which converts signal EGO into two-state signal EGOS. A high voltage state of signal EGOS indicates exhaust gases are rich of stoichiometry and a low voltage state of signal EGOS indicates exhaust gases are lean of stoichiometry. Signal EGOS may be used to advantage during feedback air/fuel control to maintain average air/fuel at stoichiometry during a stoichiometric homogeneous mode of operation. A single exhaust gas sensor may serve 1, 2, 3, 4, 5, or other number of cylinders.

Distributorless ignition system 88 provides ignition spark to combustion chamber 30 via spark plug 91 in response to spark advance signal SA from controller 12.

Controller 12 may cause combustion chamber 30 to operate in a variety of combustion modes, including a homogeneous air/fuel mode and a stratified air/fuel mode by controlling injection timing, injection amounts, spray patterns, etc. Further, combined stratified and homogenous mixtures may be formed in the chamber. In one example, stratified layers may be formed by operating injector 66 during a compression stroke. In another example, a homogenous mixture may be formed by operating one or both of injectors 66 and 67 during an intake stroke (which may be open valve injection). In yet another example, a homogenous mixture may be formed by operating one or both of injectors 66 and 67 before an intake stroke (which may be closed valve injection). In still other examples, multiple injections from one or both of injectors 66 and 67 may be used during one or more strokes (e.g., intake, compression, exhaust, etc.). Even further examples may be where different injection timings and mixture formations are used under different conditions, as described below.

Controller 12 can control the amount of fuel delivered by fuel injectors 66 and 67 so that the homogeneous, stratified, or combined homogenous/stratified air/fuel mixture in chamber 30 can be selected to be at stoichiometry, a value rich of stoichiometry, or a value lean of stoichiometry.

As described above, FIG. 1 merely shows one cylinder of a multi-cylinder engine, and that each cylinder has its own set of intake/exhaust valves, fuel injectors, spark plugs, etc. Also, in the example embodiments described herein, the engine may be coupled to a starter motor (not shown) for starting the engine. The starter motor may be powered when the driver turns a key in the ignition switch on the steering column, for example. The starter is disengaged after engine start, for example, by engine 10 reaching a predetermined speed after a predetermined time. Further, in the disclosed embodiments, an exhaust gas recirculation (EGR) system may be used to route a desired portion of exhaust gas from exhaust manifold 48 to intake manifold 43 via an EGR valve (not shown). Alternatively, a portion of combustion gases may be retained in the combustion chambers by controlling exhaust valve timing.

Controller 12 is shown in FIG. 1 as a conventional microcomputer including: central processing unit (CPU) 102, input/output (I/O) ports 104, read-only memory (ROM) 106, random access memory (RAM) 108, keep alive memory (KAM) 110, and a conventional data bus. Controller 12 is shown receiving various signals from sensors coupled to engine 10, in addition to those signals previously discussed, including measurement of inducted mass air flow (MAF) from mass air flow sensor 118; engine coolant temperature (ECT) from temperature sensor 112 coupled to cooling sleeve 114; a profile ignition pickup signal (PIP) from Hall effect sensor 38 coupled to crankshaft 40; and throttle position TP from throttle position sensor 58 and an absolute Manifold Pressure Signal MAP from sensor 122. Engine speed signal RPM is generated by controller 12 from signal PIP in a conventional manner and manifold pressure signal MAP from a manifold pressure sensor provides an indication of vacuum, or pressure, in the intake manifold. During stoichiometric operation, this sensor can give an indication of engine load. Further, this sensor, along with engine speed, can provide an estimate of charge (including air) inducted into the cylinder. In one example, sensor 38, which is also used as an engine speed sensor, produces a predetermined number of equally spaced pulses every revolution of the crankshaft. The controller 12 receives signals from the various sensors of FIG. 1 and employs the various actuators of FIG. 1, such as throttle 61, fuel injectors 66 and 67, spark plug 91, etc., to adjust engine operation based on the received signals and instructions stored on a memory of the controller. As one example, the controller may send a pulse width signal to the port injector to adjust an amount of fuel delivered to a cylinder. As another example, the controller may adjust a pulse width signal to the port injector based on a measured fuel rail temperature.

FIG. 2 illustrates a dual injector, single fuel system 200 with a high pressure and a low pressure fuel rail system. Fuel system 200 may be coupled to an engine, such as engine 10 of FIG. 1. Fuel system 200 may be operated to deliver fuel to an engine, such as engine 10 of FIG. 1. Fuel system 200 may be operated by a controller to perform some or all of the operations described with reference to the method of FIGS. 5-8. Components previously introduced a similarly numbered.

Fuel system 200 may include fuel tank 210, low pressure or lift pump 212 that supplies fuel from fuel tank 210 to high pressure fuel pump 214. Lift pump 212 also supplies fuel at a lower pressure to low pressure fuel rail 260 via fuel passage 218 (herein also known as fuel line 218). Thus, low pressure fuel rail 260 is coupled exclusively to lift pump 212. Fuel rail 260 supplies fuel to port injectors 262*a*, 262*b*, 262*c* and 262*d*. High pressure fuel pump 214 supplies pressurized fuel to high pressure fuel rail 250. Thus, high pressure fuel rail 250 is coupled to each of high pressure pump 214 and lift pump 212.

As such, fuel injectors may need to be intermittently calibrated for variability due to age and wear and tear, as well as to learn injector-to-injector variability. As a result, the actual amount of fuel injected to each cylinder of an engine may not be the desired amount and discrepancies may lead to reduced fuel economy, increased tailpipe emissions, and an overall decrease in engine efficiency. As elaborated herein with reference to FIGS. 5-8, port fuel injectors may be periodically diagnosed by disabling a lift pump, sequentially injecting from each port injector, and for each injection event, correlating injector variability with a measured drop in fuel rail pressure following each injection event.

High pressure fuel rail 250 supplies pressurized fuel to direct fuel injectors 252*a*, 252*b*, 252*c*, and 252*d*. The fuel rail pressure in fuel rails 250 and 260 may be monitored by pressure sensors 248 and 258 respectively. Lift pump 212 may be, in one example, an electronic return-less pump system which may be operated intermittently in a pulse mode. In another example, lift pump 212 may be a turbine (e.g., centrifugal) pump including an electric (e.g., DC) pump motor, whereby the pressure increase across the pump and/or the volumetric flow rate through the pump may be controlled by varying the electrical power provided to the pump motor, thereby increasing or decreasing the motor speed. For example, as the controller reduces the electrical power that is provided to lift pump 212, the volumetric flow rate and/or pressure increase across the lift pump may be reduced. The volumetric flow rate and/or pressure increase across the pump may be increased by increasing the electrical power that is provided to lift pump 212. As one example, the electrical power supplied to the lift pump motor can be obtained from an alternator or other energy storage device on-board the vehicle (not shown), whereby the control system can control the electrical load that is used to power the lift pump 212. Thus, by varying the voltage and/or current provided to the lift pump, the flow rate and pressure of the fuel provided at the inlet of the HP fuel pump 214 is adjusted.

Lift pump 212 may be equipped with a check valve 213 so that the fuel line 218 (or alternate compliant element) holds pressure while lift pump 212 has its input energy reduced to a point where it ceases to produce flow past the check valve 213. Lift pump 212 may be fluidly coupled to a filter 217, which may remove small impurities contained in the fuel that could potentially damage fuel handling components. With check valve 213 upstream of the filter 217, the compliance of low-pressure passage 218 may be increased since the filter may be physically large in volume. Furthermore, a pressure relief valve 219 may be employed to limit the fuel pressure in low-pressure passage 218 (e.g., the output from lift pump 212). Relief valve 219 may include a ball and spring mechanism that seats and seals at a specified pressure differential, for example. The pressure differential set-point at which relief valve 219 may be configured to open may assume various suitable values; as a non-limiting example the set-point may be 6.4 bar or 5 bar (g). In some embodiments, fuel system 200 may include one or more (e.g., a series) of check valves fluidly coupled to low-pressure fuel pump 212 to impede fuel from leaking back upstream of the valves.

A lift pump fuel pressure sensor 231 may be positioned along fuel passage 218 between lift pump 212 and HP fuel pump 214. In this configuration, readings from sensor 231 may be interpreted as indications of the fuel pressure of lift pump 212 (e.g., the outlet fuel pressure of the lift pump) and/or of the inlet pressure of higher pressure fuel pump. Readings from sensor 231 may be used to assess the operation of various components in fuel system 200, to determine whether sufficient fuel pressure is provided to higher pressure fuel pump 214 so that the higher pressure fuel pump ingests liquid fuel and not fuel vapor, and/or to minimize the average electrical power supplied to lift pump 212.

High pressure fuel rail 250 may be coupled to an outlet 208 of high pressure fuel pump 214 along fuel passage 278. A check valve 274 and a pressure relief valve 272 (also known as pump relief valve) may be positioned between the outlet 208 of the high pressure fuel pump 214 and the high pressure fuel rail 250. The pump relief valve 272 may be coupled to a bypass passage 279 of the fuel passage 278. Outlet check valve 274 opens to allow fuel to flow from the high pressure pump outlet 208 into a fuel rail only when a pressure at the outlet of direct injection fuel pump 214 (e.g., a compression chamber outlet pressure) is higher than the fuel rail pressure. The pump relief valve 272 may limit the pressure in fuel passage 278, downstream of high pressure fuel pump 214 and upstream of high pressure fuel rail 250. For example, pump relief valve 272 may limit the pressure in fuel passage 278 to 200 bar. Pump relief valve 272 allows fuel flow out of the DI fuel rail 250 toward pump outlet 208 when the fuel rail pressure is greater than a predetermined pressure.

Attached at the inlet of the LP fuel rail is a parallel pressure relief valve 290 for controlling fuel flow from the lift pump to the fuel rail and from the fuel rail to the lift pump. The parallel pressure relief valve 290 includes a pressure relief valve 242 and a check valve 244. The pressure check valve 244 opens upon the fuel pump delivering a predetermined pressure to the fuel line. Pressure relief valve 242 opens to allow fuel flow from the fuel line to the lift pump when the fuel line is over-pressurized. Valves 244 and 242 work in conjunction to keep the low pressure fuel rail 260 isolated from the fuel line pressure when the lift pump 212 is disabled (as elaborated in FIG. 3). The pressure relief valve 242 has a predetermined set point greater than that of the check valve is mounted in parallel therewith so that pressure in the fuel line may be maintained at an appropriate level during long deceleration periods, as well as when the engine is off. In one example, pressure relief valve 242 may help limit the pressure build up within fuel rail 260 due to thermal expansion of fuel. In another example, pressure relief valve 242 may be set to open only when the pressure within LP fuel rail 260 is above a predetermined value. For example, pressure relief valve 242 may have a predetermined set point greater than that of the check valve 244 so that the pressure within the fuel rail may be maintained at a higher pressure (e.g. at 600 kPa) than the LP fuel passage 218 (e.g. at 400 kPa) when the lift pump is turned off. In this way, LP fuel rail 260 may be isolated from the LP fuel passage 218. As a result, when the lift pump is off, a pressure drop within LP fuel rail 260 following each port fuel injection event may be amplified, improving the fidelity of a pressure drop measurement during port injector calibration (as elaborated in FIGS. 5-8).

Furthermore, the LP fuel rail may be isolated by the pressure relief valve 242 anytime the fuel rail pressure is higher than the pressure provided by the in-tank fuel pump. In one example, the PPRV near the inlet of port injection fuel rail allows the in-tank pump to first pressurize the LP fuel rail pressure to 620 kPa gauge, then the engine is allowed to return to DI-only operation at 500 kPa gauge without affecting PFI injector variability learning and vice-versa. By trapping a high pressure in the LP fuel rail, and operating the other rail or DI pump inlet at a lower pressure, port fuel injector learning may be performed while fueling the engine via the DI fuel rail.

Direct fuel injectors 252*a*-252*d* and port fuel injectors 262*a*-262*d* inject fuel, respectively, into engine cylinders 201*a*, 201*b*, 201*c*, and 201*d* located in an engine block 201. Each cylinder, thus, can receive fuel from two injectors where the two injectors are placed in different locations. For example, as discussed earlier in FIG. 1, one injector may be configured as a direct injector coupled so as to fuel directly into a combustion chamber while the other injector is configured as a port injector coupled to the intake manifold and delivers fuel into the intake port upstream of the intake valve. Thus, cylinder 201*a* receives fuel from port injector 262*a* and direct injector 252*a* while cylinder 201*b* receives fuel from port injector 262*b* and direct injector 252*b*.

While each of high pressure fuel rail 250 and low pressure fuel rail 260 are shown dispensing fuel to four fuel injectors of the respective injector group 252*a*-252*d* and 262*a*-262*d*, it will be appreciated that each fuel rail 250, 260 may dispense fuel to any suitable number of fuel injectors.

Similar to FIG. 1, the controller 12 may receive fuel pressure signals from fuel pressure sensors 258 and 248 coupled to fuel rails 260 and 250, respectively. Fuel rails 260 and 250 may also contain temperature sensors for sensing the fuel temperature within the fuel rails, such as sensors 202 and 203 coupled to fuel rails 260 and 250, respectively. Controller 12 may also control operations of intake and/or exhaust valves or throttles, engine cooling fan, spark ignition, injector, and fuel pumps 212 and 214 to control engine operating conditions.

Fuel pumps 212 and 214 may be controlled by controller 12 as shown in FIG. 2. Controller 12 may regulate the amount or speed of fuel to be fed into fuel rails 260 and 250 by lift pump 212 and high pressure fuel pump 214 through respective fuel pump controls (not shown). Controller 12 may also completely stop fuel supply to the fuel rails 260 and 250 by shutting down pumps 212 and 214.

Injectors 262*a*-262*d* and 252*a*-252*d* may be operatively coupled to and controlled by controller 12, as is shown in FIG. 2. An amount of fuel injected from each injector and the injection timing may be determined by controller 12 from an engine map stored in the controller 12 on the basis of engine speed and/or intake throttle angle, or engine load. Each injector may be controlled via an electromagnetic valve coupled to the injector (not shown). In one example, controller 12 may individually actuate each of the port injectors 262 via a port injection driver 237 and actuate each of the direct injectors 252 via a direct injection driver 238. The controller 12, the drivers 237, 238 and other suitable engine system controllers can comprise a control system. While the drivers 237, 238 are shown external to the controller 12, it should be appreciated that in other examples, the controller 12 can include the drivers 237, 238 or can be configured to provide the functionality of the drivers 237, 238.

Fuel may be delivered by both injectors to the cylinder during a single cycle of the cylinder. For example, each injector may deliver a portion of a total fuel injection that is combusted in cylinder 30 in FIG. 1. Further, the distribution and/or relative amount of fuel delivered from each injector may vary with operating conditions, such as engine load and engine speed. The port injected fuel may be delivered during an open intake valve event, closed intake valve event (e.g. substantially before the intake stroke), as well as during both open and closed intake valve operation. Similarly, directly injected fuel may be delivered during an intake stroke, as well as partly during previous exhaust stroke, during intake stroke, and partly during the compression stroke, for example. As such, even for a single combustion event, injected fuel may be injected at different timings from the port and direct injector. Furthermore, for a single combustion even, multiple injections of the delivered fuel may be performed per cycle. The multiple injections may be performed during the compression stroke, intake stroke, or any appropriate combination thereof.

In one example, the amount of fuel to be delivered via port and direct injectors is empirically determined and stored in a predetermined lookup tables or functions. For example, one table may correspond to determining port injection amounts and one table may correspond to determining direct injections amounts. The two tables may be indexed to engine operating conditions, such as engine speed and engine load, among other engine operating conditions. Furthermore, the tables may output an amount of fuel to inject via port fuel injection and/or direct injection to engine cylinders at each cylinder cycle.

Accordingly, depending on engine operating conditions, fuel may be injected to the engine via port and direct injectors or solely via direct injectors or solely port injectors. For example, controller 12 may determine to deliver fuel to the engine via port and direct injectors or solely via direct injectors, or solely via port injectors based on output from predetermined lookup tables as described above.

Various modifications or adjustments may be made to the above example systems. For example, the fuel passage 218 may contain one or more filters, pressure sensors, temperature sensors, and/or relief valves. The fuel passages may include one or more fuel cooling systems.

In this way, the components of FIGS. 1-2 enables an engine system, comprising an engine including a plurality of cylinders; a fuel injection system including a low pressure lift pump, a port injection fuel rail coupled to the lift pump via a fuel line, a plurality of port injectors coupled to the corresponding plurality of cylinders, and a pressure relief valve coupled to the fuel line, upstream of the fuel rail; a pressure sensor and a temperature sensor coupled to the fuel rail; a pedal position sensor for receiving an operator torque demand. The engine system may further include a controller configured with computer readable instructions stored on non-transitory memory for operating the lift pump until fuel rail pressure exceeds a threshold pressure, and then disabling the pump; sequentially operating each of the plurality of port injectors for a predefined number of injection events including commanding an injector pulse-width based on operator torque demand; for each of the plurality of port injectors, updating a map of injected fuel mass relative to injector pulse-width by correlating a fuel rail pressure drop at each of the predefined number of injection events to one or more of a slope and offset of the map, the fuel rail pressure drop correlated as a function of each of injection voltage and injection pressure; and after the predefined number of injection events, operating the plurality of port injectors in accordance with the updated map. The controller may be configured to further include instructions for estimating an injector current based on each of the injection voltage and a sensed fuel rail temperature; translating the correlated fuel rail pressure as a function of the injector voltage to a function of the injector current; and operating the plurality of port injectors in accordance with the further updated map. In one example, the engine may further includes a cylinder head and a cylinder head temperature sensor, wherein the operating the lift pump is performed after a sensed cylinder head temperature is above a threshold temperature.

In another example, the controller may further include instructions comprising in response to an operator torque demand, adjusting a fuel pulse-width commanded to each of the plurality of port injectors based on a parameter indicative of injector-to-injector variability, the parameter mapped as a function of injector current, the injector current based on sensed fuel rail temperature. The controller may be configured to further include instructions for mapping the parameter for each of the plurality of port injectors as a function of applied injection voltage; and then updating the mapping for each of the plurality of port injectors as the function of injector current. Referring now to FIG. 3, plot 300 depicts a graph showing the relationship between the LP fuel rail pressure drop and fuel injection quantity in a port injection system. When a lift pump is enabled, port fuel rail pressure drop (also referred herein as LP fuel rail pressure drop) increases linearly with fuel line pressure. Further, this relationship holds true for PFI operating at any pressure above the fuel vapor pressure (at present temperature). Plot 302 shows port fuel rail pressure drop increases linearly with the increase in fuel injection quantity. The slope 310 on line 302 represents fuel system stiffness when a PPRV is absent in the LP fuel rail. Plot 306 also shows a linear relationship between LP fuel rail pressure drop and port injected fuel quantity, but with an increased fuel system stiffness (shown as a steeper slope 320) since the PPRV is coupled to the fuel rail. During port injection calibration, a lift pump may be disabled after raising the fuel rail pressure to a threshold pressure. In one example, disabling the in-tank pump may include turning off the power source for the pump. Alternatively, the in-tank pump may be effectively disabled relative to the port injectors as long as the in-tank pump pressure is maintained less than the port injection fuel rail pressure.

Once the in-tank pump is disabled, the presence of a parallel pressure relief valve at an inlet of the low pressure fuel rail further isolates the fuel rail pressure, such that the fuel rail pressure is held higher than the fuel line pressure. For example, instead of following dashed segment 304 (with lower stiffness as shown by slope 310), the fuel rail pressure drop may be amplified, and therefore the fuel rail pressure drop rises at a higher rate as depicted by segment 306 (with higher stiffness as shown by slope 320). As an example, without the check valve 244 of PPRV (as described in FIG. 2), the fuel system stiffness may be 100 kPa/ml. However, by separating the fuel volumes between fuel line and LP fuel rail with check valve 244 (as described in FIG. 2), the fuel rail stiffness may be increased to 200 kPa/ml, such that for an injection of 0.02 ml, the pressure drop may become 4 kPa with the stiffer system instead of 2 kPa, thus increasing the resolution and accuracy of the pressure drop measurement.

Now turning to FIG. 4, map 400 depicts example transfer functions for different port injectors of a fuel system. The map depicts a relationship between port fuel injection quantity and fuel pulse-width for different port injectors and represents injector-to-injector variability for individual injectors. In the depicted example, transfer functions for two port fuel injectors are shown, plot 403 depicting a transfer function for a first port injector and plot 404 depicting the transfer function for a second port injector. Transfer function 403 includes a first injector offset 401 and a first slope 405 for the first injector. Transfer function 404 includes a second injector offset 402 and a second slope 406 for the second injector. The injector offsets represents a pulse-width region where no flow occurs to account for the opening time (or opening delay) of the injector. The offset is applied as an addend to a commanded injector pulse-width to enable a given fuel mass to be delivered by the corresponding injector. Since the offset represents the difference between the longer opening delay and shorter closing delay, at least the offset portion of the transfer function may be affected by injector voltage. In particular, as the injector voltage increases, the injector opening delay decreases, reducing the offset. In addition, for an inward-opening injector, the opening delay may be affected by decreasing injection pressure, the opening delay reduced, reducing the offset, as the injection pressure decreases. The slope represents injected quantity versus injector energized duration. Further, the slope also represents the short pulse-width which accounts for injector operation in a ballistic region of the injector where the injector is prone to high degrees of variability. For example, the short pulse-width may not be long enough to have the injector fully open, however, some fuel flow still occurs even if the injector pintle is not at the fully open position. The closing time of the injector valve may also be affected by the electrical current, if said current does not reach full saturation value, e.g., due to the short energization period. While the depicted examples show a single slope, it will be appreciated that the transfer function may alternatively have two or more slopes separated by breakpoints, each slope representative of the injector's performance in that flow region (e.g., a first slope corresponding to injector performance at low fuel flow rates separated by a break point from a second slope corresponding to injector performance at high fuel flow rates).

An engine controller may be configured to learn the transfer function of each port injector so as to enable accurate fuel delivery. Due to differences in manufacturing, location within manifold, ageing, wear and tear, etc., each injector's transfer function may vary at a different rate over time. Consequently, the engine controller may need to periodically learn and update the transfer functions, including the offset and the slope, for each injector.

For example, in order to accurately inject a commanded fuel quantity depicted at 414 from each of the two injectors, the controller may be configured to compensate for the injector variability of the two injectors. In particular, the controller may have to compensate for the smaller offset and steeper slope of the first injector by commanding a fuel pulse-width PW1 to the first injector. In comparison, the controller may have to compensate for the larger offset and shallower slope of the second injector by commanding a fuel pulse-width PW2 to the second injector. It will be appreciated that while only 2 injector transfer functions are described in this example, depending on the number of port injectors present in the vehicle engine, multiple such transfer functions may be stored in the controller's memory.

As elaborated herein, the controller may be configured to learn the injector variability by correlating a commanded fuel mass to a measured drop in fuel rail pressure following a port injection event with the lift pump disabled. Further, the variability may be correlated to one or more of offset and the slope of the transfer function, the correlation based on the engine speed. As one example, the variability learned at less than a threshold injection amount may be assigned to only the injector offset. In comparison, the variability learned at higher than the threshold injection amount may be assigned to only the injector slope. In another example, the assigning of the variability to the offset or the slope may be based on the pulse-width commanded during the injector calibration. For example, when smaller fuel pulse-widths are commanded (such as at low engine speeds and load), the learned variability or correction for fuel injection quantity may be assigned to only the injector offset. As another example, when larger pulse-widths are commanded (such as high engine speeds and loads), the learned variability or correction for fuel injection quantity may be assigned to only the injector slope. In this way, by periodically updating the transfer function of each port injector, injector-to-injector variability in fuel delivery is reduced, improving engine performance.

Figure 5:
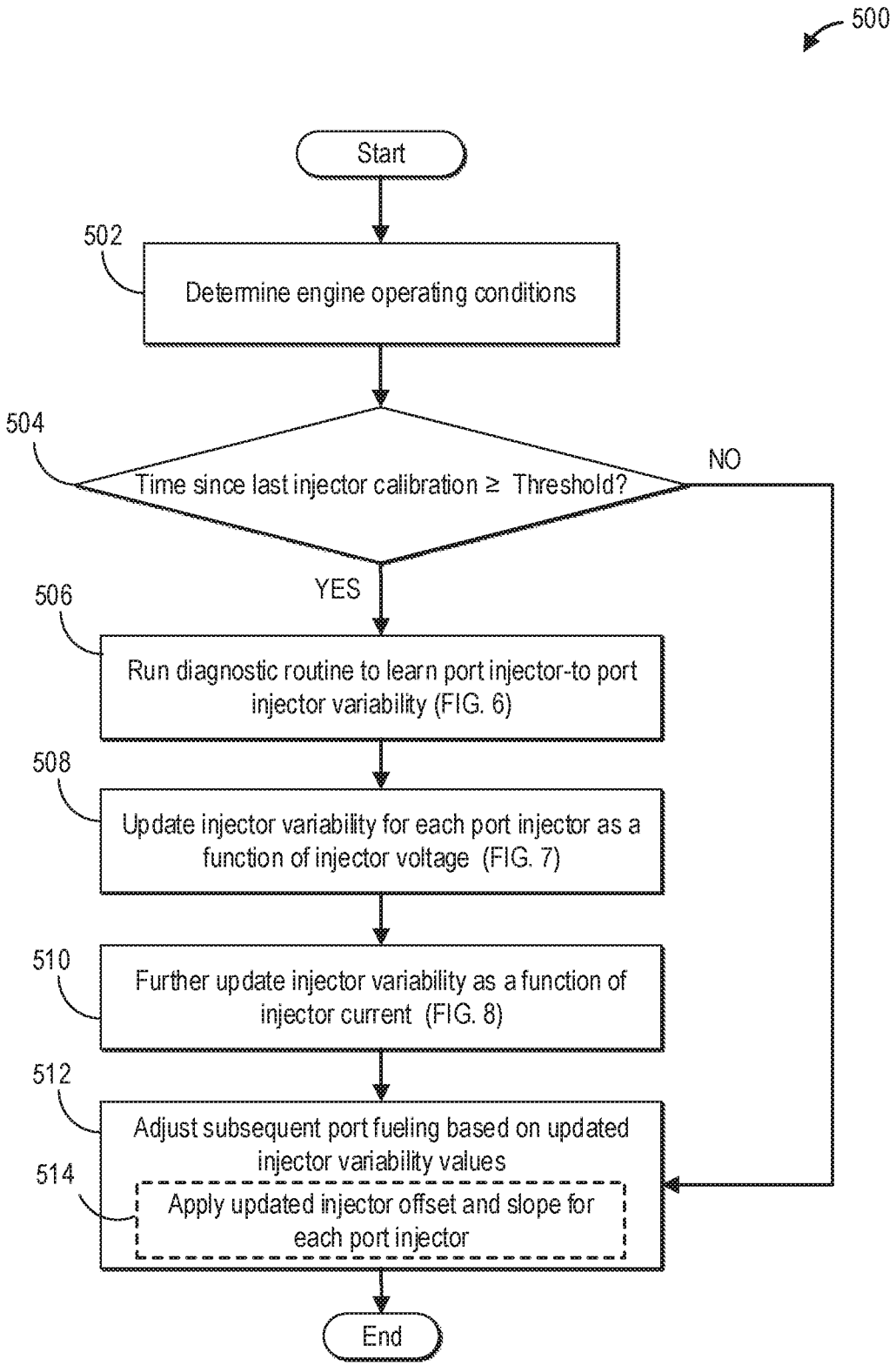
FIG. 5 is a high-level flowchart illustrating an example routine for learning port injector variability and adjusting port injection accordingly.

Referring now to FIG. 5, an example routine 500 is shown that may be performed by a controller to determine whether an injector diagnostic routine can be initiated. Instructions for carrying out method 500 and the rest of the methods included herein may be executed by a controller based on instructions stored on a memory of the controller and in conjunction with signals received from sensors of the engine system, such as the sensors described above with reference to FIGS. 1-2. The controller may employ engine actuators of the engine system to adjust engine operation, according to the methods described below.

At 502, engine operating conditions may be estimated and/or inferred. These may include, for example, engine speed, engine load, driver torque demand, ambient conditions (e.g., ambient temperature and humidity, and barometric pressure), MAP, MAF, MAT, engine coolant temperature, etc.

At 504, it may be determined if a threshold duration has elapsed since a last iteration of an injector calibration routine. In one example, injector calibration may be periodically performed, such as at least once per drive cycle, after a predetermined number of miles have been driven, or after a predetermined duration of engine operation. In one example, the calibration may be run every 10 minutes.

If the threshold time has not elapsed, then the method proceeds to 512, where fueling to cylinders is continued to be adjusted based on the most recent injector variability values. This includes, at 514, applying the most recent injector offset values and slope functions correlating injected fuel mass to injector pulse-width (such as those described at FIG. 4) for corresponding port injectors. In one example, the controller may retrieve the most recent estimate of the injector offset and slope values for corresponding injectors from a look-up table stored in the controller's memory. The method then ends.

If sufficient time has elapsed since the last iteration of the injector calibration, method 500 proceeds to 506 where an injector diagnostic routine for learning port injector-to-port injector variability is carried out, as will be described with reference to FIG. 6. The injector diagnostic routine may include calibrating each injector a predetermined number of times, and for each time the routine is run for an injector, an injector error including an offset and slope for the injector's transfer function may be determined as a function of injection pressure and injection voltage. The learned error for each injector may be averaged allowing for higher precision of injector calibration.

The controller may run the calibration in a predefined injection sequence for a predetermined number of times (e.g., 3 times). The controller may determine the order in which injectors are to be fired in the calibration injection sequence based on cylinder firing order, for example. The controller may also determine when and how many times each injector is to be fired during a calibration injection sequence. The controller may use a counting mechanism to keep track of the firing of injectors and make sure injection is cycled through all injectors before proceeding to the next calibration injection sequence. For example for a 4-cylinder engine with 4 injectors, the routine may predetermine that calibration will proceed in the following sequences for a calibration injection sequence: injector #1, #2 #3, #4 and the calibration injection sequence may be repeated 3 times in a fuel injector calibration routine. The routine may also determine that the fuel injector calibration routine may be repeated after a predetermined amount of time has elapsed (e.g., 10 min) after the conclusion of the last routine. For example, the routine may run a calibration injection routine calibrate the injector #1 at the earliest opportunity, for example after engine start and engine temperature has stabilized, then move on to calibrate the injectors #2, #3, #4 at the next available opportunities. The routine may also determine that the routine may be repeated, for example after a predetermined amount of time (e.g., 10 min) has elapsed since the last calibration cycle, or as needed, such as when a certain triggering event occurs or when engine operating conditions indicate a need to recalibrate the injectors. Examples of such conditions include when engine temperature has changed beyond a predetermined threshold since last iteration of the routine, or when an exhaust component sensor senses one or exhaust component exceeds predetermined thresholds.

At 508, upon completing the diagnostic routine, the injector variability value is updated into the controller's memory as a function of injector voltage, as will be described with reference to FIG. 7. Since fuel temperature affects injector coil temperature and thus injector performance, at 510, injector variability may be further updated as a function of injector current in the memory, the injector current learned based on sensed fuel rail temperature, as will be described with reference to FIG. 8.

Once the injector variability has been learned and updated into the memory, method 500 proceeds to 512 where port fueling to the cylinders is adjusted based on the updated injector variability values. This includes, at 514, applying the updated injector offset and slope values for corresponding port injectors.

Figure 6:
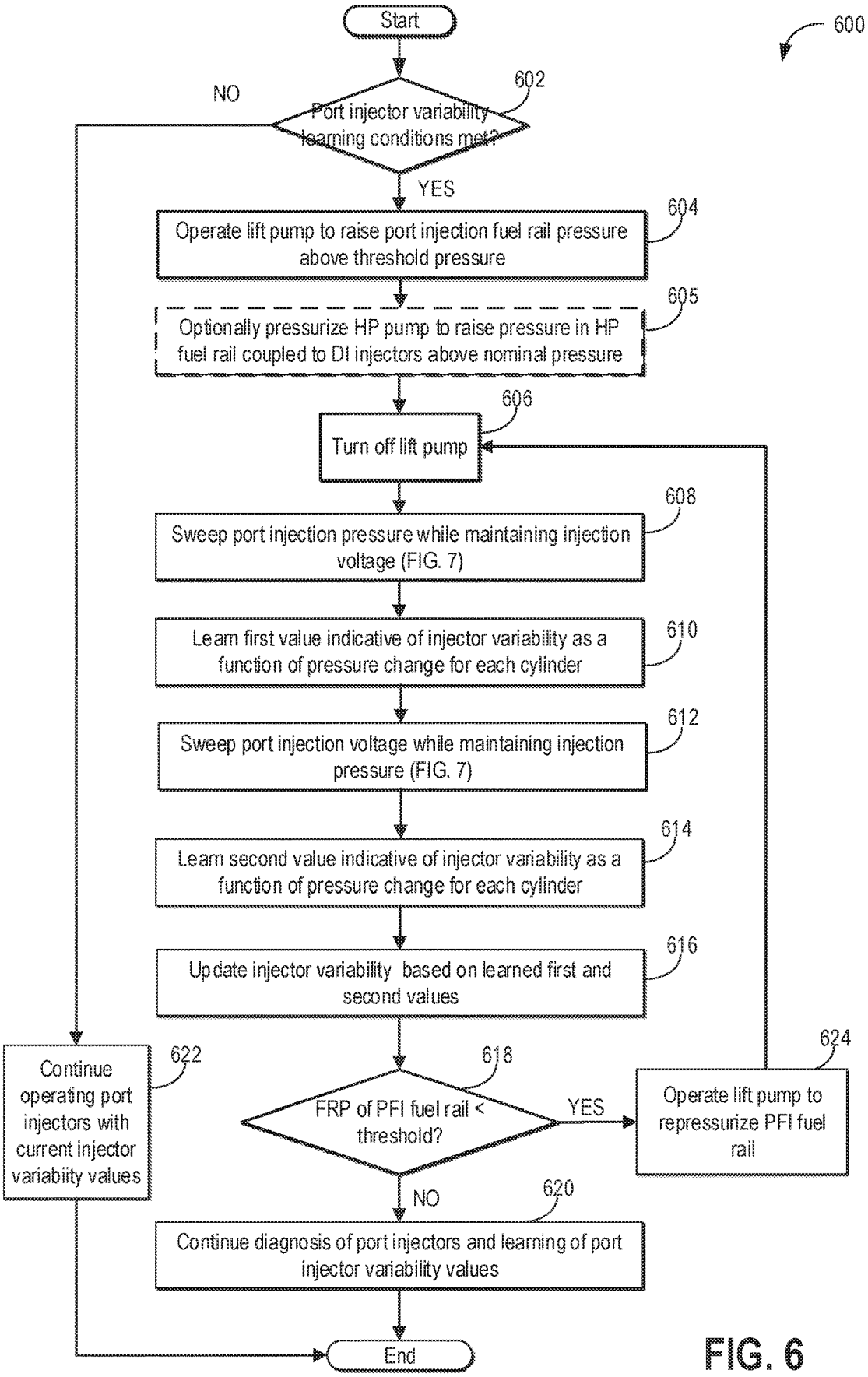
FIG. 6 is a flowchart demonstrating an example routine for learning port injector variability.

Continuing now to FIG. 6, an example diagnostic routine 600 is illustrated for calibrating each port injector of a fuel system.

At 602, it is confirmed whether port injector variability learning conditions are met. In one example, port injector variability learning conditions are considered met if the engine temperature is above a threshold temperature to ensure that port injector calibration is carried out when engine temperature has stabilized, such as after an engine hot-start, or after exhaust catalyst light-off. In particular, since temperature affects injector performance significantly, calibration may not be initiated during conditions when the engine temperature is low, such as during engine cold-start conditions, or before exhaust catalyst light-off.

If the injector variability learning conditions are not met, then the method proceeds to 622, where the controller continues to operate port injectors with the most recent (current) injector variability values and the method ends. In contrast, if the injector variability learning conditions are met, then the method proceeds to 604, where the lift pump may be operated to raise port injection fuel rail pressure (or LP fuel rail pressure) to above a threshold pressure.

At 605, the controller may optionally also operate a high pressure fuel pump coupled downstream of the lift pump to raise pressure in a high pressure fuel rail, coupled to DI injectors, above a nominal direct injection pressure. DI injectors may typically operate at higher pressures than port injectors. The inventors have recognized that pressure may be held in the HP fuel rail even after the high pressure pump is disabled if the pressure is raised sufficiently before disabling the pump. Thereafter, the bulk modulus of the fuel, and any compliance of the container enables the pressure to be held. Therefore, by optionally raising the HP fuel rail pressure before port fuel injector calibration, sufficient fuel may be available in the HP fuel rail for correct metering by the direct injector over multiple direct injection events with the HP fuel pump subsequently disabled.

In one example, the lift pump may be operated to raise a port injection fuel rail pressure above a first threshold pressure, and before disabling the lift pump, the high pressure fuel pump coupled downstream of the lift pump may be operated to raise a direct injection fuel rail pressure above a second threshold pressure, higher than the first threshold pressure. The first threshold pressure may be an upper threshold pressure for the port injection fuel rail above which the lift pump is deactivated.

Once the HP fuel rail pressure is raised to above nominal pressure, the method proceeds to 606, where the lift pump is disabled. In addition, the HP fuel pump may also be deactivated. In one example, the lift pump may be disabled after the LP fuel rail pressure has been raised to the threshold pressure. The threshold pressure may include a fuel line pressure of a fuel line coupling the lift pump to a port injection fuel rail. The port injection fuel rail pressure may be maintained above the fuel line pressure after disabling the lift pump via a pressure relief valve coupled to the fuel line at an inlet of the port injection fuel rail. By raising the port injection fuel rail pressure before initiating the port fuel injector calibration, a pressure drop associated with each port injection event may be amplified, improving the metering of the pressure drop for port injector calibration.

The controller may then proceeds to port fuel the engine while learning injector variability with the lift pump is disabled. The port fueling may include a predefined duration or a predetermined number of fuel injection events over which each of the port injectors of the engine is operated sequentially. As an example, the predefined number of port injection events may be adjusted so that each port injector is assessed at least a threshold number of times (e.g., at least once per port injector). The port injectors may be operated in accordance with their firing order during the calibration and at each injection event, the fuel amount commanded may be based on the operator torque demand and engine load.

Figure 7:
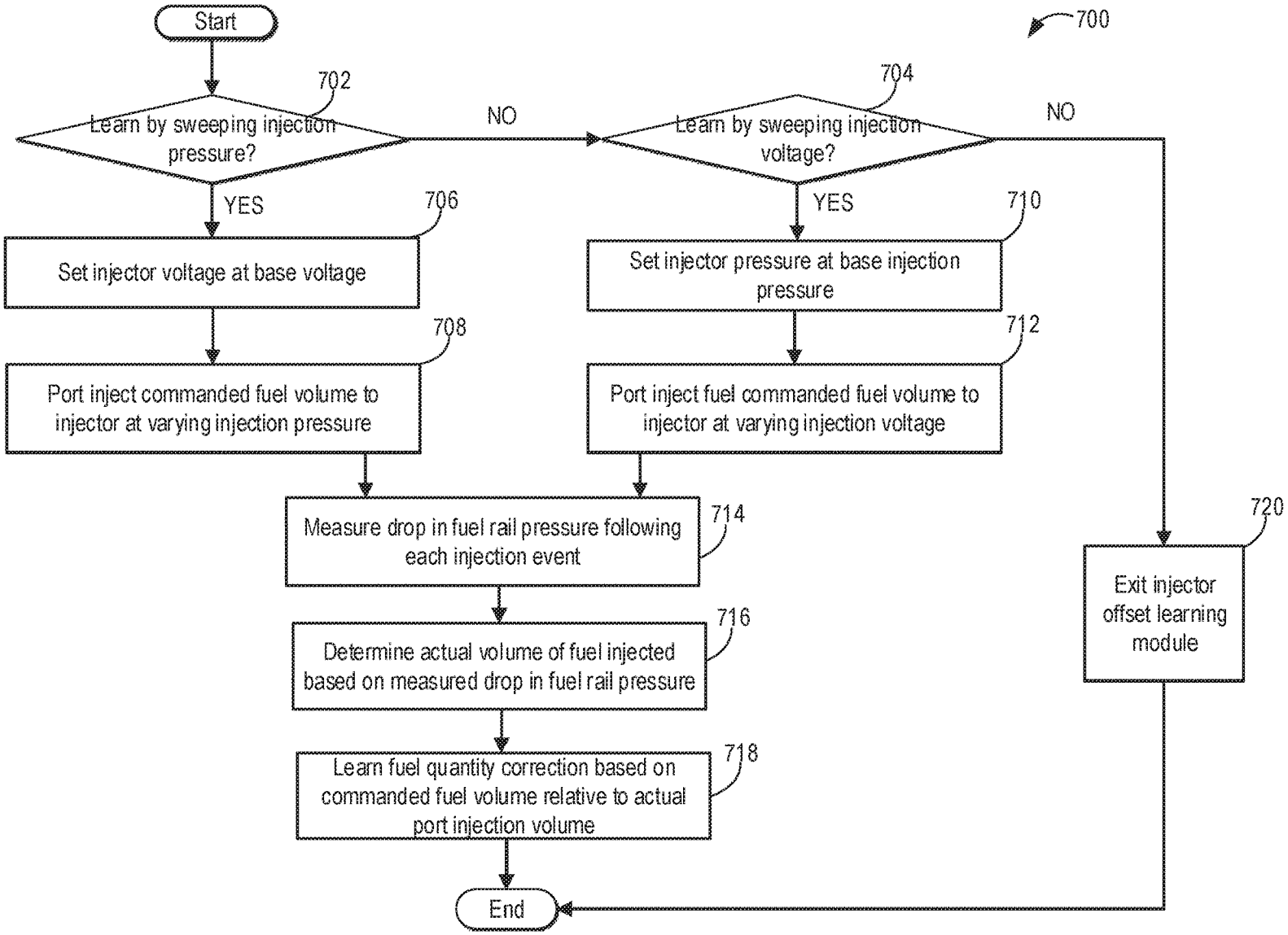
FIG. 7 is a flowchart illustrating an example routine for sweeping port fuel injection pressure while maintaining injector voltage, followed by sweeping injector voltage while maintaining injection pressure during port injector calibration.

At 608, port fueling the engine while learning the injector variability includes sweeping the port injection pressure while maintaining injection voltage, as further elaborated in FIG. 7. In one example, controller may learn the injector variability as a function of injection pressure and injection voltage while maintaining the injection voltage at a base voltage setting (e.g. at 14V). Therein, following each port injection event, performed while holding the injection voltage at the base voltage, a drop in fuel rail pressure may be measured. The drop in fuel rail pressure may be used to infer an actual fuel mass delivered and compared to the commanded fuel mass. The error is then learned as a function of the injection pressure (or fuel rail pressure) at the time of the injection event. In this way, pressure drops following multiple injection events at each injector may be learned as a function of a range of injection pressures.

At 610, a first value indicative of injector variability may be learned as a function of the measured pressure changes for each injector. For example, the first injector variability value may be learned based on the error between the measured pressure drop in fuel rail pressure and the commanded fuel mass, as injection pressure varies. The first value indicative of injector variability may include one or more of an offset and a slope of a transfer function correlating a target fuel mass to a pulse-width command delivered to a given port injector. Once the first injector variability value is learned for each port injector, the method proceeds to 612.

At 612, port fueling the engine while learning the injector variability includes sweeping the port injection voltage while maintaining injection pressure, as further described in FIG. 7. In one example, controller may learn the injector variability as a function of injection voltage while maintaining the injection pressure at a base pressure setting (e.g. at 64 psi). Therein, following each port injection event, performed while holding the injection pressure at the base pressure setting, a drop in fuel rail pressure may be measured. The drop in fuel rail pressure may be used to infer an actual fuel mass delivered and compared to the commanded fuel mass. The error is then learned as a function of the injection voltage at the time of the injection event. In one example, port injecting may be performed at the base voltage setting (e.g., 14V) and then during a subsequent injection event for the same injector, the port injecting may be performed at a second voltage setting, higher or lower than the base voltage setting (e.g., 12V). In this way, pressure drops following multiple injection events at each injector may be learned as a function of a range of injection voltages.

At 614, a second value indicative of injector variability may be learned as a function of the measured pressure changes for each injector. For example, the second injector variability value may be learned based on the error between the measured pressure drop in fuel rail pressure and the commanded fuel mass, as injection voltage varies. The second value indicative of injector variability may include one or more of an offset and a slope of a transfer function correlating a target fuel mass to a pulse-width command delivered to a given port injector. Once the second injector variability value is learned, the method proceeds to 616.

At 616, an overall injector variability is updated based on each of the learned first and second values indicative of injector variability. In one example, the two values for each injector may be used to update a map or transfer function for the corresponding injector, the transfer function relating an injected fuel mass relative to injector pulse-width command.

The controller may correlate a fuel rail pressure drop measured at each of the predefined number of port injection events for each injector to one or more of a slope and offset of the map for the corresponding injector, the fuel rail pressure drop correlated as a function of each of injection voltage and injection pressure, after the predefined number of injection events.

As such, following each injection event, as fuel flows out of the fuel rail with the lift pump disabled, the fuel rail pressure may drop. At low fuel rail pressures, there may be additional inaccuracies in fuel delivery, especially when the injected fuel volume is low, as may occur at low load conditions. In addition, there is a possibility that fuel vapor may be ingested into the injector instead of liquid fuel. Both of these may result in unintended injection errors that may confound the variability measurement. While the port injection is more fuel vapor tolerant than expected, and injection accuracy is maintained at or around fuel vapor pressure (e.g., 30 kPa above fuel vapor pressure), injector variability measurements may be compromised once the fuel rail pressure has been at or around the fuel vapor pressure for longer than a threshold duration. Thus at 618, it may be determined if the fuel rail pressure (FRP) of the PFI fuel rail is below a threshold pressure, or has been below the threshold pressure for longer than a threshold duration. In one example, the threshold pressure is a fuel vapor pressure or a function of the fuel temperature. Alternatively, it may be determined if more than a threshold volume has been delivered over a plurality of port injection events while at or around the threshold pressure.

If the FRP of the port injection fuel rail is at or below the threshold pressure, then the method proceeds to 624 where the injector calibration is temporarily suspended and the lift pump is operated to re-pressurize PFI fuel rail. In one example, the threshold pressure is a lower threshold pressure below which the pump is reactivated. The port injector calibration may be temporarily disabled until the fuel rail pressure has increased to above the upper threshold pressure (e.g., the threshold pressure to which the port injection fuel rail is pressurized at the onset of the calibration, such as discussed earlier at 604). Once the lift pump has re-pressurized the port injection fuel rail, the method returns to 606, where the lift pump is disabled and the injector calibration is resumed.

In one example, the threshold pressure may include a fuel line pressure of a fuel line coupling the lift pump to the port injection fuel rail. Responsive to the fuel rail pressure dropping below the threshold pressure during the learning, the controller may temporarily suspend the learning. Further, the controller may operate the lift pump to raise the fuel rail pressure above the fuel line pressure, and then disable the lift pump and resume the learning. The controller may note the last injector that was assessed before resuming lift pump operation. Then, upon resuming lift pump operation, the controller may resume calibration for an injector that follows the last injector in the firing order.

It will be appreciated that the controller may also determine if the fuel rail pressure of the DI fuel rail has fallen below a threshold pressure, due to direct injector operation, below which direct injection accuracy is compromised. If so, while the lift pump is operated to re-pressurize the port injection fuel rail, the high pressure fuel pump may also be opportunistically operated to re-pressurize the direct injection fuel rail.

If the FRP of the PFI fuel rail is not below the threshold pressure, then the method proceeds to 620 where the port injector calibration is continued and the port injector variability values continue to be learned. In one example, learning the injector variability values includes learning first and second injector values indicative of injector variability for each port injector, and storing them in the memory of the controller as a function of injector voltage and injector pressure (for each injector). As such, each port injector may have its own injector variability map and the learned values may be used to update the transfer function for each port injector and adjust a fuel pulse-width commanded subsequently.

In this way, port injectors may be diagnosed accurately as a function of each of injection pressure and injection voltage. The offset values may then be stored in a two-dimensional map from which the values can be easily accessed during subsequent engine fueling. By learning the injector variability by sweeping both injection voltage and injection pressure, an error of each injector may be learned that is independent of the commanded pulse-width. For example, it may be learned that a given injector always injects 3% less than intended, allowing the controller to accordingly adjust a pulse-width commanded to the given injector during subsequent operation. In one example, the controller may compensate for the error by commanding a pulse-width that corresponds to a 3% higher fuel mass than desired.

Turning now to FIG. 7, an example routine 700 is shown for learning injector variability values by sweeping injection pressure while maintaining injector voltage, followed by sweeping injection voltage while maintaining injector pressure. In one example, the routine of FIG. 7 may be performed as part of the routine of FIG. 6, such as at 608 and 612. The method allows a measured pressure drop following a port injection event with the lift pump disabled, to be correlated with a commanded fuel mass as a function of injector voltage, or injection pressure. As a result, a transfer function of the port injector can be updated.

In particular, the injector dependence on injection pressure, supply voltage level, and injector coil temperature (or resistance) may be learned and used to update an injector offset (which is the x-axis intercept of the affine line that relates fuel quantity injected to time that the injected is powered). In other words, a force required to open an injector is learned. The inventors have recognized that the opening and closing of an injector is determined based on a balance of forces. For example, to open an injected, the controller needs to apply an electromagnetic force that balances out the spring force of the injector, the pressure force, the inertial force due to the pintle and armature mass, and any additional frictional forces that oppose the motion of the pintle. By adaptively learning at least the pressure force and the electrically-generated force opening the injector, the injector offset may be reliably and accurately learned. Since the electromagnetic force that builds to open the injector is directly proportional to the current, by mapping the offset to the current, instead of the voltage, the variability may be more accurately learned and accounted for.

At 702, it is determined whether injector variability learning by sweeping injection pressure is desired. In one example, during injector calibration, injector variability may be first learned as a function of injection pressure by sweeping the injection pressure, and then as a function of injection voltage by sweeping the injection voltage. However in alternate examples, the order of learning may be reversed. Thus if it is determined that injection pressure has already been swept, the method proceeds to 704. Else, if it is determined that injection pressure has not already been swept, the method continues to 706.

At 706, the method includes setting the injector voltage to a base voltage setting. For example, the base voltage may be set at 14V. Thereafter, while the injection pressure is swept over a plurality of port injection events, the injection voltage may be maintained at the base voltage setting.

Next, at 708, the method includes commanding a fuel volume to each port injector, sequentially, at varying injection pressure. The volume commanded at each injection event may be based on the operator torque demand, the commanded volume decreasing at lower torque demand or lower engine loads and increasing at higher torque demand and higher engine loads. As discussed with reference to FIG. 6, at each injection event, fuel is port injected via an injector with the lift pump disabled. An injection pressure at the time of the injection event is inferred from the fuel rail pressure at the onset of the injection event. As each injection event progresses, and the fuel rail pressure drops, the injection pressure may also correspondingly drop, allowing a range of injection pressures to be assessed.

Returning to 704, if the controller determines that injector offset is to be learned by sweeping injection voltage, then at 710, the method includes setting the injection pressure to a base injection pressure setting. For example, the base injection pressure may be set at 9 psi above the nominal fuel rail pressure setting for port injection. In one example, the injection base pressure may be held within a narrow range, such as between 420 to 460 kPa). Thereafter, while the injection voltage is swept over a plurality of port injection events, the injection pressure may be maintained at the base pressure.

At 712, the method includes commanding a fuel volume to each port injector, sequentially, at varying injection voltage. The volume commanded at each injection event may be based on the operator torque demand, the commanded volume decreasing at lower torque demand or lower engine loads and increasing at higher torque demand and higher engine loads. As such, the injection voltage affects the opening delay of the injector, thereby affecting the offset portion of a transfer function of the injector. In particular, as the voltage is increased, the opening delay is decreased, and the offset if reduced. In one example, sweeping the voltage includes port injecting a commanded volume at a first voltage setting, such as the base voltage setting of 14V. Then, during a subsequent port injection event of the same injector, port injecting the commanded volume at a second voltage setting, higher or lower than the base voltage setting, such as at 12V. In still further examples, sequential port injection events for a given port injector may be performed at a range of incremented injector voltages, such as at 6V, 8V, 12V, and 14V. In one example, the port injector may perform an initial injection event at a base injection voltage and then increase the injection voltage by a predetermined amount or by a fractional amount from base injection voltage on each subsequent injection event.

From each of 708 and 712, the method proceeds to 714 wherein the controller measures a drop in fuel rail pressure following each port injection event. It will be understood that steps 706-718 are performed when the injector variability is being learned as a function of injection pressure by sweeping the injection pressure, while steps 704-718 are performed when the injector variability is being learned as a function of injection voltage by sweeping the injection voltage, and that the steps are not performed concurrently. For example, when injector variability is learned by sweeping injection pressure while maintaining injection voltage at a base voltage, controller may correlate fuel pressure drop at each port injection event as a function of injection pressure. Then, when injector variability is learned by sweeping injection voltage while maintaining injection pressure at a base pressure, controller may correlate fuel pressure drop at each port injection event as a function of injection voltage.

At each injection event, the controller measures a fuel rail pressure drop ($\Delta P_{ij}$) for each injection event by each injector. As an example, in a 4 cylinder engine, i=1, 2, 3, or 4 based on which injector is selected, and j=1, 2, 3, . . . 9 if each injector is injected 3 times during a calibration injection cycle and the calibration injection cycle is run 3 times during a calibration event. Thus, $\Delta P_{ij}$ corresponds to the pressure drop in the low pressure fuel rail measured for the ith injector on the jth injection event. The pressure drop may be measured via a pressure sensor coupled to the low pressure fuel rail.

Various engine operating conditions or events may affect fuel rail pressure measurements and may be taken into consideration when calculating the fuel pressure drop ($\Delta P_{ij}$) attributed to each injection event. For example, the transient pressure pulsations generated by injector firing may temporarily affect fuel rail pressure measurement, thus affecting the calibration accuracy. As such, the sampling of the fuel pressure may be selected to reduce the transient effects of injector firing. Additionally, or alternatively, if the injector firing timing is correlated to the fuel rail pressure measurement, temporary pressure drops caused by the injector firing may be taken into consideration when determining injector calibration values. Similarly, intake and/or exhaust valve opening and shutting, intake pressure and/or exhaust pressure, crank angle position, cam position, spark ignition, and engine combustion, may also affect fuel rail pressure measurements and may be correlated to the fuel rail pressure measurements to accurately calculate fuel rail pressure drop attributed to individual injection events.

As described in FIGS. 2-3, the presence of a parallel pressure relief valve at the inlet of the PFI fuel rail enables the fuel rail to be isolated once the lift pump operation is suspended. As a result, a fuel pressure drop following each port injection event may be amplified, improving the accuracy of the measurement.

At 716, the method includes an amount of fuel actually injected on each injection event based on the corresponding measured drop in PFI fuel rail pressure. For example, the controller may calculate an amount of fuel actually injected in each injection $Q_{ij}$, using the following equation:

$$Q_{ij}=\Delta P_{ij}/C$$

where C is a predetermined constant coefficient for converting the amount of fuel pressure drop to the amount of fuel injected. The controller may further determine the average amount of fuel actually injected by injector i (Qi) using the following equation:

$$Qi=\left(\sum_{i}^{j} Qij\right)/j$$

where j is the number of injections by injector i (e.g., j=1, 2, 3 . . . 9 if each injector is injected 3 times during a calibration injection cycle and the calibration injection cycle is run 3 times during a calibration event).

The controller may then compare the calculated actuated volume (Qi) for each injection event to the commanded volume (Qc) for the corresponding injection event. The commanded volume may have been determined based on the engine operating conditions, such as based on engine speed and load. In one example, the commanded volume may be determined from the pulse-width commanded to the injector during each injection event (at 708 or 712).

At 718, the method includes learning a fuel quantity correction based on the commanded fuel volume relative to the actual injection volume. In one example, the controller may calculate a first value indicative of injector variability, or a first correction coefficient for injector i (e.g., i=1, 2, 3, or 4 for a four cylinder engine) using the following equation: $k_i=Q_c/Q_i$ based on the data collected during the sweeping of injection pressure. The first value may correlate the error between the actual volume delivered by an injector and the volume commanded to the injector as a function of injection pressure. The controller may further calculate a second value indicative of injector variability, or a second correction coefficient for injector i (e.g., i=1, 2, 3, or 4 for a four cylinder engine) using the following equation: $k_i=Q_c/Q_i$ based on the data collected during the sweeping of injection voltage. The second value may correlate the error between the actual volume delivered by an injector and the volume commanded to the injector as a function of injection voltage. The controller may then determine an updated transfer function for each injector, including an updated offset value and an updated slope value, for each injector based on the first and second values indicative of injector variability, as a function of injection voltage and pressure. Further, based on the commanded pulse-width, and/or engine speed at the time of the injection event, the error may be attributed to the offset or the slope portion of the transfer function. For example, at lower commanded pulse-widths (e.g., at pulse-widths lower than a threshold width), or lower engine speeds (e.g., engine speeds lower than a threshold speed), a larger portion of the injector variability (or error) may be assigned to an offset of the injector. In one example, all injector variability (or error) learned at lower commanded pulse-widths or lower engine speeds may be assigned to an offset of the injector. As another example, at higher commanded pulse-widths (e.g., at pulse-widths higher than the threshold width), or higher engine speeds (e.g., engine speeds higher than the threshold speed), a larger portion of the injector variability (or error) may be assigned to a slope of the injector. In one example, all injector variability (or error) learned at higher commanded pulse-widths or higher engine speeds may be assigned to a slope of the injector.

The transfer function may then be updated in the controller's memory. For example, the controller may replace the stored offset and slope values in the controller's memory with the new calculated values following each iteration of the port injector calibration routine.

During subsequent engine operation with port injection, a fuel pulse-width and duty cycle commanded to the port injector may be adjusted based on the updated transfer function and updated offset and slope values to compensate for over-fueling or under-fueling errors of the injector. For example, if it was determined that the actual fuel volume delivered by an injector is more than the commanded fuel volume, then the fuel injection pulse-width may be reduced as a function of the learned difference. In another example, if it was determined that the actual fuel volume delivered by an injector is less than the commanded fuel volume, the controller may increase the pulse-width and duty cycle commanded to the port injector based on the learned difference.

In this way, a port injection fuel quantity delivered from each port injector may be corrected based on a function correlating a measured fuel rail pressure drop as a function of each of injection voltage and injection pressure. The correlating includes correlating fuel rail pressure drop at each port injection event to a parameter indicative of injector variability as a function of injection pressure by sweeping injection pressure while maintaining injection voltage at a first setting; and then correlating fuel rail pressure drop at each port injection event to the parameter indicative of injector variability as a function of injection voltage by maintaining injection pressure while transitioning injection voltage between the first setting and a second setting, higher than the first setting.

In one example, learning variability between port injectors of the engine includes, for each port injector, updating each of an injector offset and a slope function correlating injected fuel mass to injector pulse-width. In a further example, fuel pulse-width commanded during the port fueling may be based on engine speed, and wherein the learning is further based on the commanded fuel pulse-width, the learned variability attributed to the injector offset when the commanded fuel pulse-width is lower than a threshold pulse-width, the learned variability attributed to the injector slope when the commanded fuel pulse-width is higher than the threshold pulse-width.

In one example, injector variability learning for each of the plurality of port injectors may be comprising of updating a map of injected fuel mass relative to injector pulse-width by correlating a fuel rail pressure drop at each of the predefined number of injection events to one or more of a slope and offset of the map, the fuel rail pressure drop correlated as a function of each of injection voltage and injection pressure; and after the predefined number of injection events, operating the plurality of port injectors in accordance with the updated map.

The inventors herein have recognized that in addition to injector variability caused due to injection pressure and injection voltage, port injectors have significant variability with injection temperature, which in turn is affected by fuel temperature. This is due to the effect of the temperature on the injector's resistance, which affects the injector current. Port fuel injectors may be more sensitive to temperature changes due to their location. As a result, even small changes in injection temperature can have a significant effect on injector resistance. In addition, the injection temperature affects the fuel density at the time of injection, causing further unintended variations in actual fuel mass being delivered relative to the desired fuel mass. Since injector resistance is related to injector current, injector variability may be more accurately determined as a function of injector current instead of injector voltage. The routines described in FIGS. 6-7 may be used by an engine controller to map an initial estimate of injector variability by correlating fuel pressure drops as a function of injection voltage and injection pressure at each port injection event. Then, the controller may update the initial estimate of port injector variability as a function of injector current by translating the learned post injector variability as a function of injector voltage (described in FIGS. 6-7), to a function of injection current, the current based on sensed port injection fuel rail temperature, as elaborated with reference to FIG. 8.

The inventors have herein recognized that in a PFI fuel system, the stiffness of the fuel system is dependent on fuel temperature (which in turn is a function of the fuel rail temperature). When fuel is near its vapor pressure, its physical properties differs significantly. Thus, operating PFI well above vapor pressure is recommended since fuel physical properties such as density and bulk modulus, are likely to be more consistent. In addition, fuel system stiffness also forms the underlying basis of the relationship between fuel rail pressure drops for any given fuel injection quantity and affects the gain of the fuel injection system, as described previously in FIG. 3. Thus, learning injector variability based on fuel temperature may increase the fuel injection accuracy of PFI fuel system.

Figure 8:
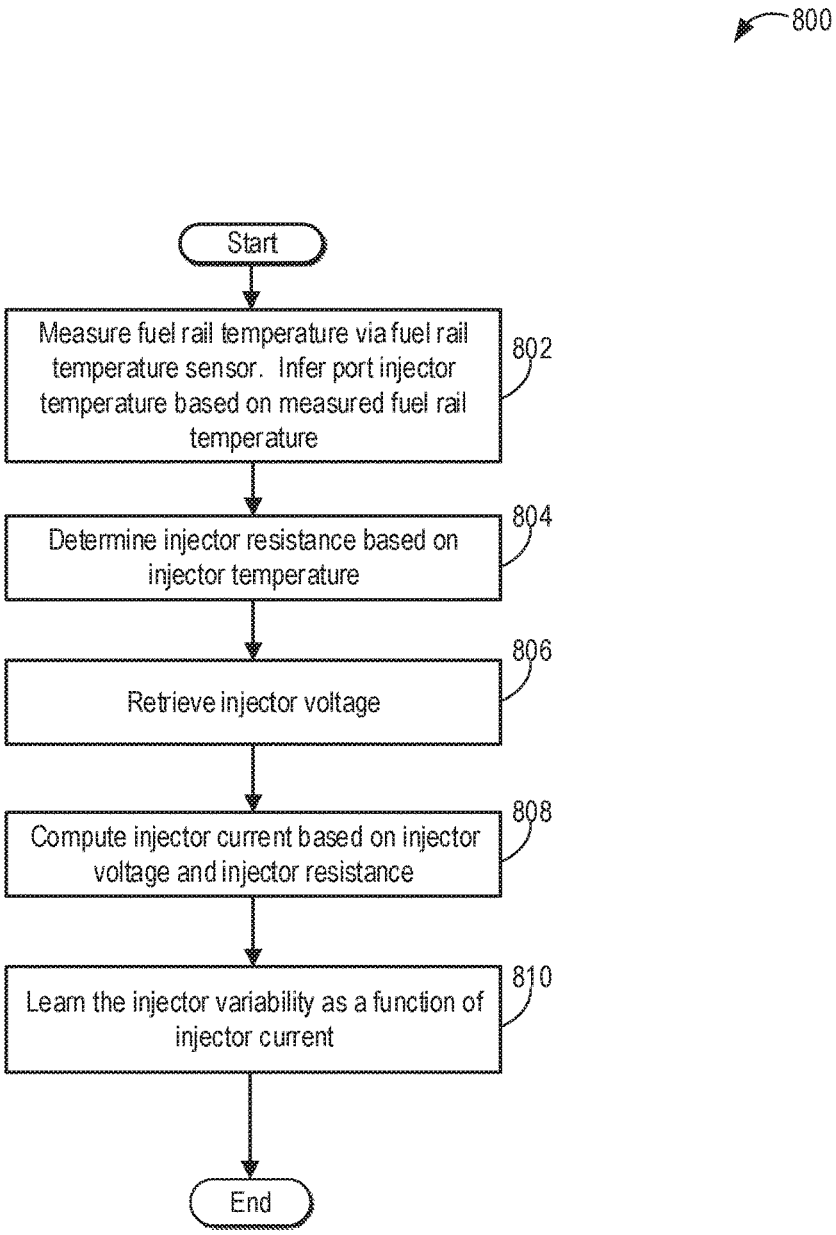
FIG. 8 is a flowchart illustrating an example routine for learning a parameter indicative of port injector variability during a port injector calibration event.

Now referring to FIG. 8, a routine to translate an injector offset based on a function relating injection voltage and injection pressure to a function of injector current is shown. By inferring injector current based on measured fuel rail temperature, and using the injector current as an additional factor in determining port injector variability, port injectors may be calibrated more accurately. In addition, a pulse-width command may be delivered to an injector with increased independence from injector coil temperature.

At 802, the method includes measuring a fuel rail temperature at a time of injector calibration via a fuel rail temperature sensor. The controller may then infer a port injector temperature (e.g., injector coil temperature or cylinder head temperature) based on the measured fuel rail temperature. In one example, the sensed injector temperature may be based on the output of an existing temperature sensor coupled to a port injection fuel rail delivering fuel to each port injector of the engine.

At 804, the method includes determining injector resistance at the time of running the calibration routine based on the inferred port injector temperature. For example, the injector resistance, ρ(T), may be calculated by using the following equation, assuming a linear approximation:

$$R(T)=R_0[1+\alpha(T-T_0)]$$

where α is the temperature coefficient of resistivity of an injector coil (e.g., α of copper=0.004/° C.), $T_0$ is a fixed reference temperature (e.g., room temperature), and $R_0$ is the injector resistance at base temperature (e.g., room temperature).

At 806, the method includes retrieving the injector voltage. For example, the injector voltage applied during the learning of an initial estimate of port injector variability as a function of injector pressure during the calibration routine may be retrieved from the controller's memory. In one example, the injector voltage is 14V.

At 808, the method include computing an injector current based on the retrieved injector voltage and the calculated injector resistance (from step 804), by using the following equation:

$$I = \frac{V}{R(T)}$$

where R(T) is the injector resistance at the measured temperature and V is the injector voltage obtained from routine 700.

At 810, the method includes learning injector variability as a function of injector current, by using the following equation:

$$\text{Offset} = (f[\text{current}_{base}] + f[\text{current}_{learned}]) \times \left(\text{gain}_{base} \times \frac{P}{P_{base}}\right) + \left(\text{gain}_{learned} \times \frac{P}{P_{base}}\right)$$

where the base current and base gain functions may be predetermined values provided by the manufacturer, the learned current function may be determined based on the method described in step 808, and the learned gain function may be inferred based on the measured pressure drops during port injection calibration (described in FIG. 7). In one example, the learned current function may be determined by learning an offset addend in an interpolated table and the learned gain function may be determined by learning a scalar.

The controller may optionally transform the variability offset map to a new function relating injection pressure and injector current. This may be done by correcting each data point in the variability to account for injector resistance. For example, a variability value for a first injector at a first pressure and first voltage may be transformed into a variability value for the first injection at the first pressure and a first current corresponding to the first voltage in view of the temperature measured at the time of the calibration. Likewise, the map for a given injector at each pressure and voltage, as well as the map for each injector, may be updated.

In one example, the injector offset is first learned as a fixed, mapped function of voltage, such as in an interpolated table. The offset interpolated table is then transformed into learned values by having an adapted (learned) term that adds to the offset. As such, it is the current that influences the opening time of the injector, not the voltage. With typical PFI injector drivers, current is not measured. By computing current as a ratio of injector supply voltage to resistance, where resistance is inferred via an injector temperature model, the effect of the current on the opening time of the injector can be learned. Cylinder head temperature and/or PFI fuel rail temperature are used as inputs to a temperature model. In this way, the electrical force component of injector offset is more accurately characterized and is applicable over a wider range of injector temperatures.

In one example, the relationship between fuel mass and pulse-width may be mapped as a function of injection current, then the map may be updated by updating the relationship to a function of injector current determined based on the injection voltage and sensed injector temperature (step 808), and subsequently engine fueling may be adjusted based on the updated mapping.

In this way, piece-to-piece variability in port fuel injectors can be more accurately determined by accounting for variation in temperature and voltage of injection. A port fuel injector may be more precisely calibrated by learning port injector variability based on injector current and injector pressure, instead of injector voltage and pressure. By computing injector offset values over a range of injector coil resistances (which change over injector temperature), a more accurate fuel quantity may be injected, improving engine performance.

Figure 10:
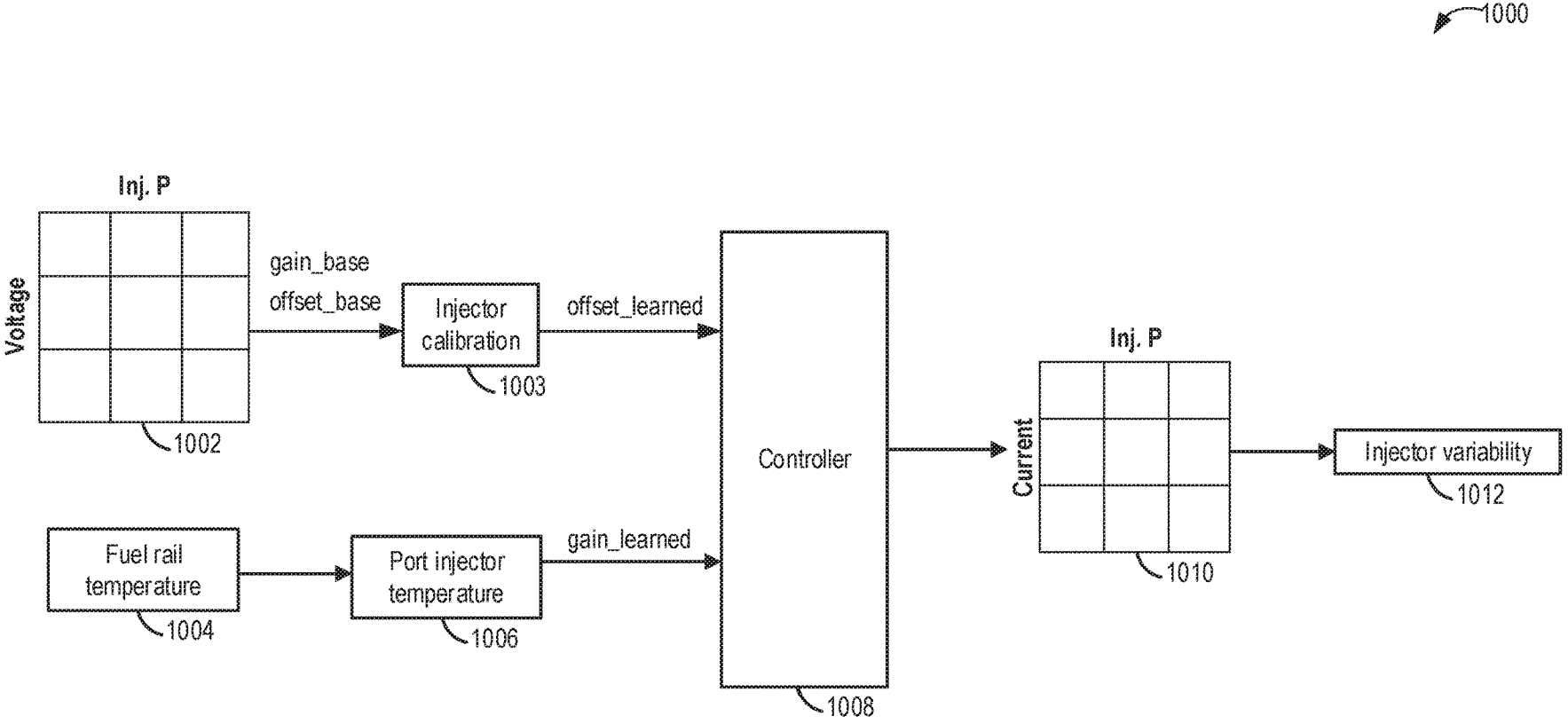
FIG. 10 shows a schematic depiction of port injector offset map transformation from an initial function relating injection pressure and injection voltage to an updated function relating injection pressure and injection current.

Referring now to FIG. 10, a schematic block diagram of an example routine for transforming an injector variability map of a given port injector, indexed based on injection pressure and injector voltage, into a new injector variability map indexed based on injection pressure and injector current, is shown.

Method 1000 starts with retrieving an initial injector variability map 1002 indexed based on injection pressure and injection voltage. The initial injector variability map may include a base gain value (gain_base) and a base offset value (offset_base) as well as a base piece to piece variability estimate (P/P base) learned over prior iterations of an injector calibration routine. Based on data collected during a port injector calibration routine 1003 (e.g., the routine of FIGS. 6-7), such as based on a measured drop in fuel rail pressure following a port injection event with the lift pump disabled and while sweeping injection pressure and then sweeping injection voltage, an offset addend may be learned (offset_learned). A fuel rail temperature 1004 may be sensed via a fuel rail temperature sensor at the time of the calibration. Thus fuel rail temperature 1004 may correspond to the temperature at the time of the mapping of map 1002. Based on the measured fuel rail temperature 1004, an injector temperature 1006 (e.g., an injector coil temperature) may be inferred. A scalar (gain_learned) may learned as a function of the measured fuel rail temperature.

The offset addend (offset_learned) and the scalar (gain_learned) may then be used to learn an injector variability estimate that is applied to the interpolated injector offset map 1002 at controller 1008 to output an updated injector offset map 1010. For example, the offset or variability may be learned according to the following equation:

$$\text{Offset} = (f[\text{current}_{base}] + f[\text{current}_{learned}]) \times \left(\text{gain}_{base} \times \frac{P}{P_{base}}\right) + \left(\text{gain}_{learned} \times \frac{P}{P_{base}}\right)$$

In this way, the initial map 1002 based on each of the injection voltage and injection pressure may be translated into the updated map 1010 based on injection current and injection pressure by accounting for an injector resistance determined based on the inferred injector temperature. An injector variability estimate 1012 is then retrieved from the updated map 1010 at a time of port injection and used for adjusting a pulse-width commanded to the given port injector.

In this way, injector-to-injector variability between port injectors may be accurately learned and accounted for by adjusting subsequent engine fueling. Further, port injectors may be commanded to operate at commanded fuel pulse-width based on operator torque and sensed fuel temperature, whereby the fuel pulse-width commanded may be independent of the injector voltage applied during the subsequent engine fueling. By compensating the port injector based on the learned variability, the accuracy of port fuel injection may be increased and overall engine performance may be improved.

Figure 9:
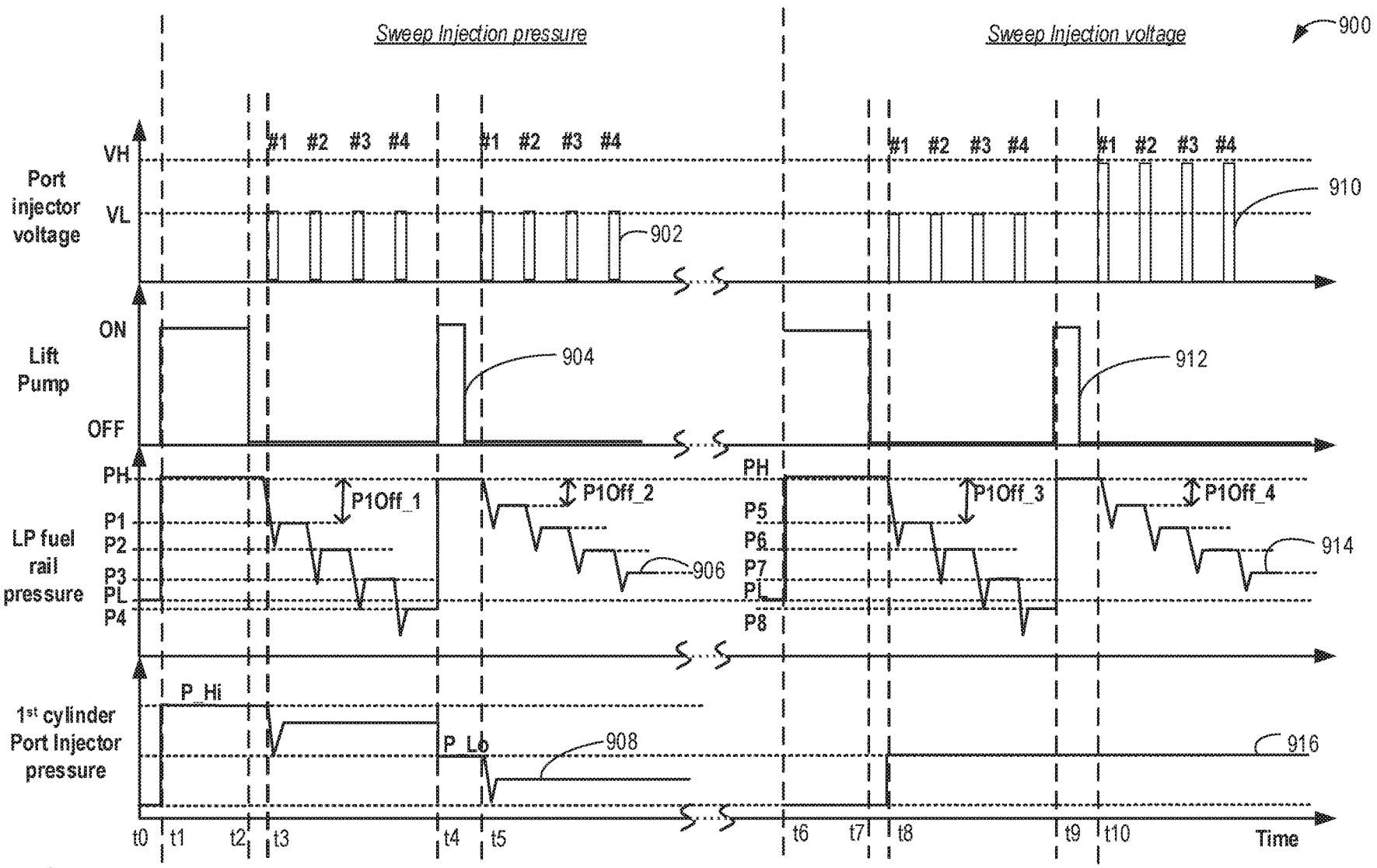
FIG. 9 shows a graph illustrating an example port fuel injector calibration.

Now turning to FIG. 9, an example port fuel injection diagnostic routine is shown. The routine includes learning a first value indication of injector variability by sweeping injection pressure (between t0 and t5) and then learning a second value indication of injector variability by sweeping injection voltage (between t6 and t10). Map 900 depicts port fuel injection timing for each cylinder during the injection pressure sweep at plot 902 with its corresponding lift pump command valve position at plot 904, fuel pressure change in the LP fuel rail at plot 906, and the port injector pressure in the first cylinder at plot 908. Map 900 further depicts fuel injection timing during the injection voltage sweep at plot 910 with its corresponding lift pump command valve position at plot 912, fuel pressure change in the PFI fuel rail at plot 914, and the port injector pressure in the first cylinder at plot 916. The example depicted is for a 4-cylinder engine (e.g., having cylinders firing in the order #1, #2, #3, and #4) where port injector #1 is coupled to cylinder #1, port injector #2 is coupled to cylinder #2, port injector #3 is coupled to cylinder #3, and port injector #4 is coupled to cylinder #4. It is to be understood that only port fuel injection timing is shown in this example and the port fuel injection is run in a pre-determined sequence of injector #1, injector #2, injector #3, and injector #4. All plots are depicted over time along the x-axis. Time markers t1-t10 depict time points of significance during port fuel injector calibration.

Prior to the calibration injection cycle, between t0 and t1, the fuel pressure in the LP fuel rail coupled port injectors is maintained at a nominal operating pressure via adjustments to operation of a lift pump. While not shown, fuel pressure in a HP fuel rail coupled direct injectors is also maintained at a nominal operating pressure via adjustments to operation of a high pressure fuel pump. Each cylinder may be fueled via direct injectors only, port injectors only, or via both injectors depending on the engine operating conditions.

At t1, port injector calibration conditions may be considered met, for example, due to a threshold duration having elapsed since a last iteration of the port injector calibration routine. At the start of the calibration, between t1 and t2, the lift pump is operated to pump fuel into the LP fuel rail in order to increase fuel rail pressure and to ensure sufficient fuel supply in the fuel rail for the subsequent injection events. Thus, at t1, the LP fuel rail pressure is increased to an upper threshold, PH. Once the LP fuel rail is sufficiently pressurized, at t2, the lift pump is disabled. At this time, LP fuel rail pressure is maintained at PH before port fuel injection cycles begin. At the beginning of port injection pressure sweep, the injection pressure is maintained at higher setting, P_Hi, during the first part of the calibration, and at a lower setting, P_Lo, during the second part of the port injector calibration, while maintaining the injector voltage constant, at base voltage, VL, as shown on 902. In one example, VL may be set to 14V.

At t3, while the injection pressure is set at P_Hi, port injector #1 starts injecting fuel at a commanded fuel pulse-width into the first cylinder, followed by injector #2 into the second cylinder, injector #3 into the third cylinder, and injector #4 into the fourth cylinder. After each port injection event, the pressure drops in the LP fuel rail, as shown in plot 906. The pressure drop for each injection event is measured and learned such that pressure drop P1 corresponds to port injector #1, P2 corresponds to port injector #2, and so on.

At t4, the fuel pressure in the LP fuel rail, after injector #4 injection, falls below a threshold PL, below which injection accuracy and calibration accuracy is compromised. Thus at t4, the port injector calibration is temporarily suspended, and lift pump is activated to re-pressurize the fuel rail as shown in plot 904. Optionally, the HP pressure pump may also be activated at the same time to opportunistically re-pressurize the HP fuel rail.

Once the LP fuel rail is re-pressurized, the lift pump is disabled and the port injection pressure sweep resumes. Therein, port injection pressure is maintained at a lower setting, P_Lo while the injector voltage for each port injector remains unchanged, at base voltage VL. At t5, port injector #1 begins port fuel injection at the commanded fuel pulse-width into the first cylinder, followed by the rest of the port injectors in the firing sequence. The pressure drop in the fuel rail after each injection event is monitored and correlated as a function of injection pressure.

In one example, the pressure drop in port injector #1 may be recorded as P1Off_1 and correlated as a function of injection pressure P_Hi, and the second pressure drop for injector #1, P1Off_2, may be correlated as a function of injection pressure P_Lo. The first value indicative of the injector variability for port injector #1 may be stored as two separate values or it may be averaged and stored as a single value, as a function of injection pressure.

It will be appreciated that herein only two injection pressure settings, P_Hi and P_Lo, are swept in this example. However, the port injection pressure sweep may include more than 2 different pressures during the calibration cycle. For example, port injection pressure sweep cycle may include a high, an intermediate, and a low injection pressure such that each port injector variability value may be correlated to 3 separate injection pressure settings.

After injection pressure is swept, the controller may determine that conditions are met for sweeping the injection voltage for the port fuel injectors. Thus, at t6, the lift pump is enabled in order to raise the fuel rail pressure to above the threshold pressure.

Once the LP fuel rail is pressurized, at t7, the lift pump is disabled. At this time, LP fuel rail pressure is maintained at PH before port fuel injection begin. At the beginning of port injection voltage sweep, the injection voltage is maintained at a lower setting, for example at base voltage, VL, in the first part of the calibration, and at a higher injection voltage setting, VH, in the second part of the port injection calibration, while maintaining the injection pressure constant, at base pressure P_Lo, as shown on 916. In one example, P_Lo may be set at 380 kPa.

In another example, the fuel rail pressure may be increased by enabling the lift pump so that the fuel rail pressure is raised to a high pressure (e.g. at 580 kPa). Once the fuel rail is pressurized, the lift pump is disabled and while maintaining the injection voltage constant, the pressure drops after each injection is measured. Since manifold air pressure (MAP) is dependent on the operator torque demand, during the injection voltage sweep, the MAP pressure may be set at a base MAP pressure where no airflow is present (e.g. at $MAP_{vacuum}$=70 kPa). Thus, in this case, the injection pressure may be kept at pressure slightly over the base pressure. As an example, if the base injection pressure is 380 kPa, the injection pressure during the voltage sweep may be maintained at MAP+base injection pressure=450 kPa.

At t8, while the injection voltage is set at VL, port injector #1 starts injecting fuel at the commanded fuel pulse-width into the first cylinder, followed by injector #2 into the second cylinder, injector #3 into the third cylinder, and injector #4 into the fourth cylinder. After each port injection event, the pressure drops in the low pressure fuel rail, as shown in plot 914, is monitored such that pressure drop P1 corresponds to port injector #1, P2 corresponds to port injector #2, and so on.

At t9, the fuel pressure in the LP fuel rail, after injector #4 injection, falls below a threshold PL, and thus, the port injector calibration is temporarily suspended, and lift pump is activated to re-pressurize the fuel rail as shown in plot 912. Alternatively, the HP pressure pump may also be activated at the same time to re-pressurize both, LP and HP fuel rail.

Once LP fuel rail is re-pressurized at t10, the lift pump is disabled and the second part of the port injection voltage sweep resumes. In the second part of the injection voltage sweep, port injection voltage is maintained at a higher setting, VH, while the injection pressure for each port injector remains unchanged, at base voltage P_Lo. At t10, port injector #1 begins port fuel injection at the commanded fuel pulse-width into the first cylinder, followed by the rest of the port injectors in the firing sequence. The pressure drop in the fuel rail after each injection event is monitored and correlated as a function of injection pressure.

In one example, the pressure drop in port injector #1 may be recorded as P1Off_3 and correlated as a function of injection voltage VL, and the second pressure drop for injector #1, P1Off_4, may be correlated as a function of injection voltage VH. The second value indicative of the injector variability for port injector #1 may be stored as two separate values or it may be averaged and stored as a single value, as a function of injection voltage.

It will be appreciated that herein only two injection voltage settings, VL and VH, are swept in this example. However, the port injection voltage sweep may include more than 2 different pressures during the calibration cycle. For example, port injection voltage sweep cycle may include a high, an intermediate, and a low injection voltage such that each port injector variability value may be correlated to 3 separate injection voltage settings.

Thus, port injector variability may be learned by correlating fuel rail pressure drop at each port injection event to the parameter indicative of injector variability as a function of injection pressure with injection pressure swept while maintaining injection voltage at a first setting; and then correlating fuel rail pressure drop at each port injection event to the parameter indicative of injector variability as a function of injection voltage by maintaining injection pressure while transitioning injection voltage between the first setting and a second setting, higher than the first setting. In one example, the port fuel injection may be operated sequentially based on the commanded fuel pulse-width. In another example, the parameter indicative of injector variability may include one or more of an offset and a slope of a function correlating injected fuel mass to injector pulse-width. In a further example, the correlating may further include correlating the fuel pressure drop to the offset when the pulse-width is under a threshold value.

In this way, injector-to-injector variability in port injectors may be reduced by adjusting subsequent engine fueling based on the updated mapping. Further, port injectors may be commanded to operate at commanded fuel pulse-width based on operator torque and sensed fuel temperature, whereby the fuel pulse-width commanded may be made independent of the injector voltage applied during the subsequent engine fueling. By compensating the port injector based on the learned variability, the accuracy of port fuel injection quantity may be increased and the overall engine performance may be improved. By also compensating for temperature induced variability, and the effect of temperature on injector current, port fuel injector calibration is rendered more reliable.

One example method for an engine comprises: port fueling an engine with fuel rail pressure above a threshold pressure and a lift pump disabled; learning variability between port injectors of the engine based on a measured drop in the fuel rail pressure, as a function of each of injection pressure and injection voltage, for each injection event of the port fueling; and adjusting subsequent port fueling of the engine based on the learning. In the preceding example, the method additionally or optionally further comprises temporarily operating the lift pump to raise the fuel rail pressure above the threshold pressure, and then disabling the lift pump. In any or all of the preceding examples, additionally or optionally, the threshold pressure includes a fuel line pressure of a fuel line coupling the lift pump to a port injection fuel rail, and wherein the threshold pressure is maintained above the fuel line pressure after disabling the pump via a pressure relief valve coupled to the fuel line at an inlet of the port injection fuel rail. In any or all of the preceding examples, the method additionally or optionally further comprises responsive to the fuel rail pressure dropping below the threshold pressure during the learning, temporarily suspending the learning, operating the lift pump to raise the fuel rail pressure above the threshold pressure, then disabling the lift pump and resuming the learning. In any or all of the preceding examples, additionally or optionally, learning variability between port injectors of the engine includes, for each port injector, updating each of an injector offset and a slope of a function correlating injected fuel mass to injector pulse-width. In any or all of the preceding examples, additionally or optionally, a fuel pulse-width commanded during the port fueling is based on engine speed, and wherein the learning is further based on the commanded fuel pulse-width, the learned variability attributed to the injector offset when the commanded fuel pulse-width is lower than a threshold pulse-width, the learned variability attributed to the injector slope when the commanded fuel pulse-width is higher than the threshold pulse-width. In any or all of the preceding examples, additionally or optionally, the adjusting subsequent port fueling of the engine based on the learning includes commanding a fuel pulse-width to a given port injector of the engine based on the updated injector offset and updated slope for the given port injector. In any or all of the preceding examples, additionally or optionally, the adjusting further includes: for a given port injector, estimating an injector current as a function of the injection voltage and a measured fuel rail temperature; transforming the learned variability, including each of the updated injector offset and slope, as a function of the injection voltage to an updated variability as a function of the estimated injector current; and commanding a fuel pulse-width to the given port injector based on the updated variability. In any or all of the preceding examples, additionally or optionally, learning the variability as a function of each of injection pressure and injection voltage includes, while maintaining injection voltage at a base voltage setting, learning the variability as a correlation between the measured drop in fuel rail pressure as injection pressure varies. In any or all of the preceding examples, additionally or optionally, learning the variability as a function of each of injection pressure and injection voltage further includes, while maintaining injection pressure at a base pressure setting, learning the variability as a correlation between the measured drop in fuel rail pressure at each of the base voltage setting, and a higher than base voltage setting. In any or all of the preceding examples, additionally or optionally, the port fueling with the lift pump disabled and the learning are performed after an engine temperature is above a threshold temperature, the method further comprising, when the engine temperature is below the threshold temperature, delaying the port fueling with the lift pump disabled and the learning. In any or all of the preceding examples, additionally or optionally, the port fueling includes a predetermined number of fuel injection events, and wherein during the port fueling, each of the port injectors of the engine is operated sequentially.

Another example method for an engine comprises: operating a lift pump to raise a port injection fuel rail pressure above a threshold pressure and then disabling the lift pump; for a predefined number of subsequent port injection events, sequentially operating each port injector of the engine; correlating fuel rail pressure drop at each port injection event, as a function of injection pressure and injection voltage, to a parameter indicative of injector variability for a corresponding port injector; and after the predefined number of port injection events, adjusting a fuel pulse-width commanded to each port injector based on the parameter for the corresponding port injector. In the preceding example, additionally or optionally, the correlating includes: correlating fuel rail pressure drop at each port injection event to the parameter indicative of injector variability as a function of injection pressure by sweeping injection pressure while maintaining injection voltage at a first setting; and then correlating fuel rail pressure drop at each port injection event to the parameter indicative of injector variability as a function of injection voltage by maintaining injection pressure while transitioning injection voltage between the first setting and a second setting, higher than the first setting. In any or all of the preceding examples, additionally or optionally, sequentially operating each port injector of the engine includes commanding a pulse-width at each port injection event based on engine speed, wherein the parameter indicative of injector variability includes, for each port injector, one or more of an offset and a slope of a function correlating injected fuel mass to injector pulse-width, and wherein the correlating further includes, correlating the fuel pressure drop to the offset when the engine speed is lower than a threshold speed, and correlating the fuel pressure drop to the slope when the engine speed is higher than the threshold speed. In any or all of the preceding examples, additionally or optionally, the threshold pressure is a first threshold pressure, the method further comprising, before disabling the lift pump, operating a high pressure fuel pump coupled downstream of the lift pump to raise a direct injection fuel rail pressure above a second threshold pressure, higher than the first threshold pressure. In any or all of the preceding examples, additionally or optionally, the predefined number of subsequent port injection events is adjusted to enable each port injector of the engine to be sequentially operated at least a threshold number of times.

Another example engine system comprises: an engine including a plurality of cylinders; a fuel injection system including a low pressure lift pump, a port injection fuel rail coupled to the lift pump via a fuel line, a plurality of port injectors coupled to the corresponding plurality of cylinders, and a pressure relief valve coupled to the fuel line, upstream of the fuel rail; a pressure sensor and a temperature sensor coupled to the fuel rail; a pedal position sensor for receiving an operator torque demand; and a controller with computer readable instructions stored on non-transitory memory for: operating the lift pump until fuel rail pressure exceeds a threshold pressure, and then disabling the pump; sequentially operating each of the plurality of port injectors for a predefined number of injection events including commanding an injector pulse-width based on operator torque demand; for each of the plurality of port injectors, updating a map of injected fuel mass relative to injector pulse-width by correlating a fuel rail pressure drop at each of the predefined number of injection events to one or more of a slope and offset of the map, the fuel rail pressure drop correlated as a function of each of injection voltage and injection pressure; and after the predefined number of injection events, operating the plurality of port injectors in accordance with the updated map. In the preceding example, the controller may additionally or optionally include further instructions for estimating an injector current based on each of the injection voltage and a sensed fuel rail temperature; translating the correlated fuel rail pressure as a function of the injector voltage to a function of the injector current; and further updating the map of injected fuel mass relative to injector pulse-width based on the injector current; and operating the plurality of port injectors in accordance with the further updated map. In any or all of the preceding examples, additionally or optionally, the engine system further includes a cylinder head and a cylinder head temperature sensor, and wherein the operating the lift pump is performed after a sensed cylinder head temperature is above a threshold temperature.

Another example method for an engine comprises: learning port injector variability as a function of injector current, the injector current estimated based on sensed port injection fuel rail temperature; and adjusting port fueling of the engine based on the learning. In the preceding examples, additionally or optionally, the learning includes: learning an initial estimate of the port injector variability as a function of injector voltage; translating the injector voltage to the injector current based on the sensed port injection fuel rail temperature; and then updating the initial estimate of the port injector variability as a function of the injector current. In any or all of the preceding examples, additionally or optionally, learning the initial estimate of the port injector variability as a function of injector voltage includes port fueling the engine with fuel rail pressure above a threshold pressure and with a lift pump disabled; and while maintaining injection pressure at a base pressure setting, learning the initial estimate of port injector variability for each port injector of the engine based on a correlation between a measured drop in the fuel rail pressure for each injection event of the port fueling at each of a first, lower injector voltage setting, and a second, higher injector voltage setting. In any or all of the preceding examples, additionally or optionally, learning the port injector variability includes, for each port injector of the engine, updating each of an injector offset and a slope of a function correlating injected fuel mass to injector pulse-width, and wherein the learning is initiated after an engine temperature is above a threshold temperature. In any or all of the preceding examples, additionally or optionally, the port fueling with the lift pump disabled includes sequentially commanding a fuel pulse-width to each port injector of the engine, the commanded fuel pulse-width based on operator torque demand. In any or all of the preceding examples, additionally or optionally, learning the initial estimate is further based on the commanded fuel pulse-width, a larger portion of the learned initial estimate attributed to the injector offset when the commanded fuel pulse-width is lower than a threshold pulse-width, the larger portion of the learned initial estimate attributed to the injector slope when the commanded fuel pulse-width is higher than the threshold pulse-width. In any or all of the preceding examples, additionally or optionally, the adjusting port fueling of the engine based on the learning includes, after the learning, commanding a fuel pulse-width to a given port injector based on the updated injector offset and updated slope corresponding to the given port injector. In any or all of the preceding examples, additionally or optionally, the port fueling with the lift pump disabled further includes a predetermined number of fuel injection events over which each port injector of the engine is sequentially operated a threshold number of times. In any or all of the preceding examples, additionally or optionally, port fueling the engine with the fuel rail pressure above the threshold pressure and with the lift pump disabled includes temporarily operating the lift pump to raise the fuel rail pressure above the threshold pressure, and then disabling the lift pump, and wherein the fuel rail temperature is sensed via a temperature sensor coupled to a fuel rail delivering fuel to engine port injectors. In any or all of the preceding examples, additionally or optionally, the threshold pressure includes a fuel line pressure of a fuel line coupling the lift pump to a port injection fuel rail, wherein the threshold pressure is maintained above the fuel line pressure after disabling the pump via a pressure relief valve coupled to the fuel line at an inlet of the port injection fuel rail.

Another example method comprises: for each port injector of an engine, mapping a relationship between fuel mass and pulse-width, as a function of injection voltage; updating the mapping of the relationship to a function of injector current, the injector current based on the injection voltage and a sensed injector temperature; and adjusting subsequent engine fueling based on the updated mapping. In the preceding example, additionally or optionally, mapping the relationship includes estimating each of an initial offset and an initial slope of the relationship as a function of the injection voltage, wherein updating the mapping includes updating each of the initial offset and the initial slope of the relationship as a function of the injection current. In any or all of the preceding examples, additionally or optionally, the sensed injector temperature is based on output of a temperature sensor coupled to a port injection fuel rail delivering fuel to each port injector of the engine. In any or all of the preceding examples, additionally or optionally, the mapping the relationship as a function of injection voltage is performed with a lift pump delivering fuel to the port injection fuel rail disabled, and with a port injection fuel rail pressure above a threshold pressure, and wherein the updating the mapping is performed independent of a lift pump operating state. In any or all of the preceding examples, additionally or optionally, the adjusting subsequent engine fueling based on the updated mapping includes commanding a fuel pulse-width to each port injector of the engine based on operator torque demand and sensed injector temperature, the fuel pulse-width commanded independent of the injector voltage applied during the subsequent engine fueling. In any or all of the preceding examples, additionally or optionally, the mapping is performed while an engine temperature is above a threshold temperature, and wherein the updating the mapping is performed independent of the engine temperature.

Another example engine system comprises: an engine including a plurality of cylinders; a fuel injection system including a low pressure lift pump, a port injection fuel rail coupled to the lift pump via a fuel line, a plurality of port injectors coupled to the corresponding plurality of cylinders, and a pressure relief valve coupled to the fuel line, upstream of the fuel rail; a pressure sensor and a temperature sensor coupled to the fuel rail; a pedal position sensor for receiving an operator torque demand; and a controller with computer readable instructions stored on non-transitory memory for: in response to an operator torque demand, adjusting a fuel pulse-width commanded to each of the plurality of port injectors based on a parameter indicative of injector-to-injector variability, the parameter mapped as a function of injector current, the injector current based on sensed fuel rail temperature. In the preceding example, additionally or optionally, the controller includes further instructions for mapping the parameter for each of the plurality of port injectors as a function of applied injection voltage; and then updating the mapping for each of the plurality of port injectors as the function of injector current. In any or all of the preceding examples, additionally or optionally, the mapping the parameter as a function of applied injection voltage includes sequentially operating the plurality of port injectors with the lift pump disabled and the fuel rail pressure above a threshold pressure; applying an injector voltage while maintaining an injection pressure at a base pressure; and correlating a measured drop in fuel rail pressure following each injection event with the parameter at the applied injector voltage. In any or all of the preceding examples, additionally or optionally, mapping the parameter includes, for each of the plurality of port injectors, mapping one or more of a slope and an offset of a function correlating injection fuel mass to commanded fuel pulse-width.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for an engine, comprising:

sweeping port injection pressure while maintaining an applied injection voltage at a port injector downstream of a fuel rail;

inferring injector resistance of the port injector from a sensed fuel rail temperature of the fuel rail;

estimating injector current based on the applied injection voltage and the inferred injector resistance;

learning port injector variability as a function of the injector current; and adjusting port fueling of the engine based on the learning.

2. A method for an engine, comprising:

learning port injector variability as a function of injector current by port fueling the engine with a fuel rail pressure above a threshold pressure and with a lift pump disabled, including temporarily operating the lift pump to raise the fuel rail pressure above the threshold pressure, and then disabling the lift pump, wherein the injector current is estimated based on port injection fuel rail temperature sensed via a temperature sensor coupled to a fuel rail delivering fuel to engine port injectors; and adjusting the port fueling of the engine based on the learning.

3. The method of claim 2, wherein the learning includes:

learning an initial estimate of the port injector variability as a function of injector voltage;

translating the injector voltage to the injector current based on the sensed port injection fuel rail temperature; and then updating the initial estimate of the port injector variability as a function of the injector current.

4. The method of claim 3, wherein learning the initial estimate of the port injector variability as a function of injector voltage includes:

port fueling the engine with the fuel rail pressure above the threshold pressure and with the lift pump disabled; and while maintaining injection pressure at a base pressure setting, learning the initial estimate of port injector variability for each port injector of the engine based on a correlation between a measured drop in the fuel rail pressure for each injection event of the port fueling at each of a first, lower injector voltage setting and a second, higher injector voltage setting.

5. The method of claim 4, wherein learning the port injector variability includes, for each port injector of the engine, updating each of an injector offset and a slope of a function correlating injected fuel mass to injector pulse-width, and wherein the learning is initiated after an engine temperature is above a threshold temperature.

6. The method of claim 5, wherein the port fueling with the lift pump disabled includes sequentially commanding a fuel pulse-width to each port injector of the engine, the commanded fuel pulse-width based on operator torque demand.

7. The method of claim 6, wherein learning the initial estimate is further based on the commanded fuel pulse-width, a larger portion of the learned initial estimate attributed to the injector offset when the commanded fuel pulse-width is lower than a threshold pulse-width and the larger portion of the learned initial estimate attributed to the injector slope when the commanded fuel pulse-width is higher than the threshold pulse-width.

8. The method of claim 7, wherein the adjusting port fueling of the engine based on the learning includes, after the learning, commanding the fuel pulse-width to a given port injector based on the updated injector offset and the updated injector slope corresponding to the given port injector.

9. The method of claim 6, wherein the port fueling with the lift pump disabled further includes a predetermined number of fuel injection events over which each port injector of the engine is sequentially operated a threshold number of times.

10. The method of claim 2, wherein the threshold pressure includes a fuel line pressure of a fuel line coupling the lift pump to a port injection fuel rail, and wherein the threshold pressure is maintained above the fuel line pressure after disabling the lift pump via a pressure relief valve coupled to the fuel line at an inlet of the port injection fuel rail.

11. A method, comprising:

for each port injector of an engine, mapping a relationship between fuel mass and fuel pulse-width, as a function of injection voltage, including estimating each of an initial offset and an initial slope of the relationship as the function of the injection voltage; and updating the mapping of the relationship to a function of injector current, the injector current based on the injection voltage and a sensed injector temperature, wherein the updating includes updating each of the initial offset and the initial slope of the relationship as the function of the injection current; and adjusting subsequent engine fueling based on the updated mapping.

12. The method of claim 11, wherein the sensed injector temperature is based on output of a temperature sensor coupled to a port injection fuel rail delivering fuel to each port injector of the engine.

13. The method of claim 12, wherein the mapping of the relationship as the function of injection voltage is performed with a lift pump delivering fuel to the port injection fuel rail disabled and with a port injection fuel rail pressure above a threshold pressure, and wherein the updating of the mapping is performed independent of a lift pump operating state.

14. The method of claim 11, wherein the adjusting subsequent engine fueling based on the updated mapping includes commanding the fuel pulse-width to each port injector of the engine based on operator torque demand and the sensed injector temperature, the fuel pulse-width commanded independent of the injection voltage applied during the subsequent engine fueling.

15. The method of claim 11, wherein the mapping is performed while an engine temperature is above a threshold temperature, and wherein the updating of the mapping is performed independent of the engine temperature.

* * * * *